US007395590B2

(12) United States Patent
Johnson et al.

(10) Patent No.: US 7,395,590 B2
(45) Date of Patent: Jul. 8, 2008

(54) METHOD FOR ASSEMBLING A FRAME ASSEMBLY FOR A CHAIR

(75) Inventors: Eric Johnson, Hudsonville, MI (US); Steve Gager, Holland, MI (US); Wesley D. Mersman, Holland, MI (US); Larry A. Wilkerson, Comstock Park, MI (US)

(73) Assignee: Haworth, Inc., Holland, MI (US)

( * ) Notice: Subject to any disclaimer, the term of this patent is extended or adjusted under 35 U.S.C. 154(b) by 177 days.

(21) Appl. No.: 11/450,915

(22) Filed: Jun. 9, 2006

(65) Prior Publication Data

US 2007/0000112 A1 Jan. 4, 2007

Related U.S. Application Data

(60) Provisional application No. 60/689,762, filed on Jun. 10, 2005.

(51) Int. Cl.

| | |
|---|---|
| ***B68G 7/00*** | (2006.01) |
| ***B21D 39/00*** | (2006.01) |
| ***A47C 7/00*** | (2006.01) |
| ***A47C 7/02*** | (2006.01) |

(52) U.S. Cl. ..... 29/91; 29/91.5; 29/448; 29/463; 29/469; 29/469.5; 297/440.11; 297/445.1; 297/452.1; 297/452.13; 297/452.18

(58) Field of Classification Search ..... 29/91.1, 29/91.5, 448, 450, 463, 469, 469.5, 525.14; 297/440.11, 440.14, 440.2, 445.18, 451.1, 297/451.8, 452.1, 452.13, 452.18
See application file for complete search history.

(56) References Cited

U.S. PATENT DOCUMENTS

| | | | |
|---|---|---|---|
| 1,864,477 | A | 6/1932 | Stannard |
| 3,197,789 | A | 8/1965 | Ashkouti et al. |
| 3,214,314 | A | 10/1965 | Rowbottam |
| 3,601,446 | A | 8/1971 | Horby et al. |
| 3,640,576 | A | 2/1972 | Morrison et al. |
| 3,804,462 | A | 4/1974 | Kobayashi |
| 3,895,141 | A | 7/1975 | Steele et al. |
| 4,299,645 | A | 11/1981 | Newsom |
| D274,768 | S | 7/1984 | Ohl |
| 4,552,406 | A | 11/1985 | Ohl |
| 4,743,323 | A | 5/1988 | Hettinga |

(Continued)

FOREIGN PATENT DOCUMENTS

| | | |
|---|---|---|
| EP | 1 226 774 A1 | 7/2002 |

*Primary Examiner*—Jermie E Cozart
(74) *Attorney, Agent, or Firm*—Flynn, Thiel, Boutell & Tanis, P.C.

(57) ABSTRACT

An office chair is provided having a contoured back assembly comprising a back frame and a suspension fabric. The fabric is attached to the back frame about its periphery wherein the back frame has a three-dimensional contoured shape formed by overlapped frame rings with the fabric being joined thereto. The fabric is secured to the frame by a machine wherein the fabric is first stretched from the outer edge of the fabric and then is clamped by a front frame section in the pre-tensioned or pre-streched condition. The fabric edges are allowed to hang loose and then fixed in the front frame section. Once secured, the fabric is unclamped from the front frame section, and then this sub-assembly is affixed to the rear frame ring to complete the assembly of the back frame.

20 Claims, 31 Drawing Sheets

U.S. PATENT DOCUMENTS

| | | | | |
|---|---|---|---|---|
| 5,178,815 | A | 1/1993 | Yokote et al. | |
| 5,318,348 | A | 6/1994 | Hess | |
| 5,662,383 | A | 9/1997 | Hand | |
| 5,768,761 | A | 6/1998 | Zeiler et al. | |
| 6,065,197 | A | 5/2000 | Iseki et al. | |
| 6,125,521 | A | 10/2000 | Stumpf et al. | |
| 6,254,190 | B1 | 7/2001 | Gregory | |
| 6,292,990 | B1 | 9/2001 | Iseki et al. | |
| 6,315,364 | B1 | 11/2001 | Fujita et al. | |
| 6,328,548 | B1 | 12/2001 | Salas et al. | |
| 6,378,944 | B1 | 4/2002 | Weisser | |
| 6,444,152 | B1 | 9/2002 | Salas et al. | |
| 6,508,509 | B2 * | 1/2003 | Peterson | 297/218.4 |
| 6,540,950 | B1 | 4/2003 | Coffield | |
| 6,550,866 | B1 | 4/2003 | Su | |
| 6,702,390 | B2 | 3/2004 | Stumpf et al. | |
| 6,758,528 | B2 * | 7/2004 | Kawashima | 297/452.56 |
| 2002/0106479 | A1 | 8/2002 | Coffield et al. | |
| 2002/0195863 | A1 | 12/2002 | Su | |
| 2003/0071509 | A1 | 4/2003 | Neil et al. | |
| 2003/0160494 | A1 | 8/2003 | Coffield | |
| 2004/0104615 | A1 | 6/2004 | Coffield et al. | |
| 2005/0044678 | A1 * | 3/2005 | Cvek | 29/91.5 |
| 2005/0248205 | A1 * | 11/2005 | Neil et al. | 297/452.18 |
| 2005/0273991 | A1 * | 12/2005 | Nagele | 29/91.7 |

* cited by examiner

METHOD FOR ASSEMBLING A FRAME ASSEMBLY FOR A CHAIR

CROSS REFERENCE TO RELATED APPLICATION

This application claims the benefit of U.S. Provisional Application Ser. No. 60/689,762, filed Jun. 10, 2005, which is incorporated herein by reference in its entirety.

FIELD OF THE INVENTION

The invention relates to an office chair with an improved chair back and more particularly, to a chair back with a peripheral frame and a suspension fabric which is secured to the frame by an improved attachment apparatus and method.

BACKGROUND OF THE INVENTION

Preferably, conventional office chairs are designed to provide significant levels of comfort and adjustability. Such chairs typically include a base which supports a tilt control assembly to which a seat assembly and back assembly are movably interconnected. The tilt control mechanism includes a back upright which extends rearwardly and upwardly and supports the back assembly rearwardly adjacent to the seat assembly. The tilt control mechanism serves to interconnect the seat and back assembly so that they may tilt rearwardly together in response to movements by the chair occupant and possibly to permit limited forward tilting of the seat and back. Further, such chairs typically permit the back to also move relative to the seat during such rearward tilting.

The back assembly of such office chairs may have a variety of constructions wherein one type of construction includes an annular back frame which defines an open interior in which the chair occupant's back is,supported. This central open area is enclosed by a suspension fabric which spans the opening and has the outer peripheral edge thereof affixed to the annular frame.

The back frame further has a section thereof rigidly connected to an upright of the chair. The upright is connected to a tilt control mechanism, which mechanism supports the seat assembly and governs rearward tilting of the upright. As such, the back assembly moves in combination with the upright when the occupant reclines within the chair.

It is an object of the invention to provide an office chair having a chair back arrangement which is improved relative to prior chair back constructions and specifically is improved relative to the attachment of a suspension fabric to the rigid back frame.

Therefore, the invention relates to an office chair and more particularly, to the construction of a chair back assembly and the process for stretching and attaching the suspension fabric to the back frame in a stretched condition.

The back assembly comprises an annular frame having a suspension fabric which spans the central opening of the back and has the periphery of the suspension fabric connected to the frame. The fabric is stretched over and wraps sidewardly and rearwardly about the frame edge so that the frame is wrapped in fabric.

To achieve this finished appearance, the frame is formed of two ring-like frame sections that are mated together in facing relation. The suspension fabric comprises a single layer of suspension material which has its peripheral edge first connected to one of the frame sections when the fabric is stretched to form a sub-assembly and then this sub-assembly is affixed to the other frame sections with the fabric periphery sandwiched therebetween.

To form a peripheral channel for receipt of the fabric edge, the back frame is constructed of molded front and back rings which define the two frame sections. A thin groove is defined about their common peripheries in which groove the peripheral edge of the fabric is secured.

The front and rear ring sections overlie each other in opposing relation and are rigidly secured together by suitable fastening means such as ultrasonic welding, adhesives or even threaded fasteners. In this manner, complex contours may be formed in a molded back frame while still permitting the formation of a securement channel about the periphery thereof.

Before the frame is assembled, the suspension fabric is first fastened to one of the ring sections and preferably the front ring section by securement means such as ultrasonic welding. This fabric is pre-stretched during assembly and then secured to the front ring section before the front ring section is affixed to the rear ring section.

The process involves securing the fabric to the frame in a stretched condition, wherein an edge portion is released and secured to the frame while the major interior portion of the fabric is held in the stretched condition against the ring section. This is accomplished by stretching the fabric through a group of peripheral clamp assemblies which are all displaceable for such stretching of the fabric.

Once stretched, the ring section is positioned against a clamping body above the stretched fabric. The clamping body then moves the ring section downwardly against the fabric while the fabric is then pressed downwardly against a bottom nest which clamps the fabric between the bottom nest and the exterior face of the ring section. This clamps the fabric in a stretched condition, and the clamps are removed thereby leaving the peripheral edge of the fabric loose and projecting outwardly of the frame. The fabric is then wrapped over the edge of the ring section and secured to the interior ring face by suitable attachment means such as ultrasonic welding or even mechanical fasteners.

Thereafter, the clamping body is lifted, and the ring/fabric sub-assembly is ultrasonically welded to the rear ring section to define a composite chair frame with a suspension fabric.

The foregoing features provide an improved back frame arrangement, wherein other objects and purposes of the invention, and variations thereof, will be apparent upon reading the following specification and inspecting the accompanying drawings.

Figure 2:
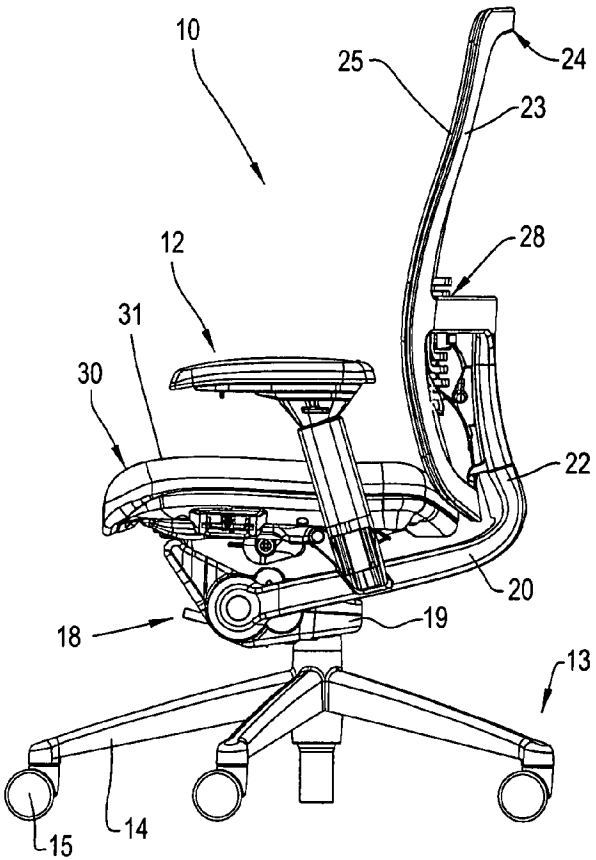
FIG. 2 is a side elevational view of the office chair.
Figure 1:
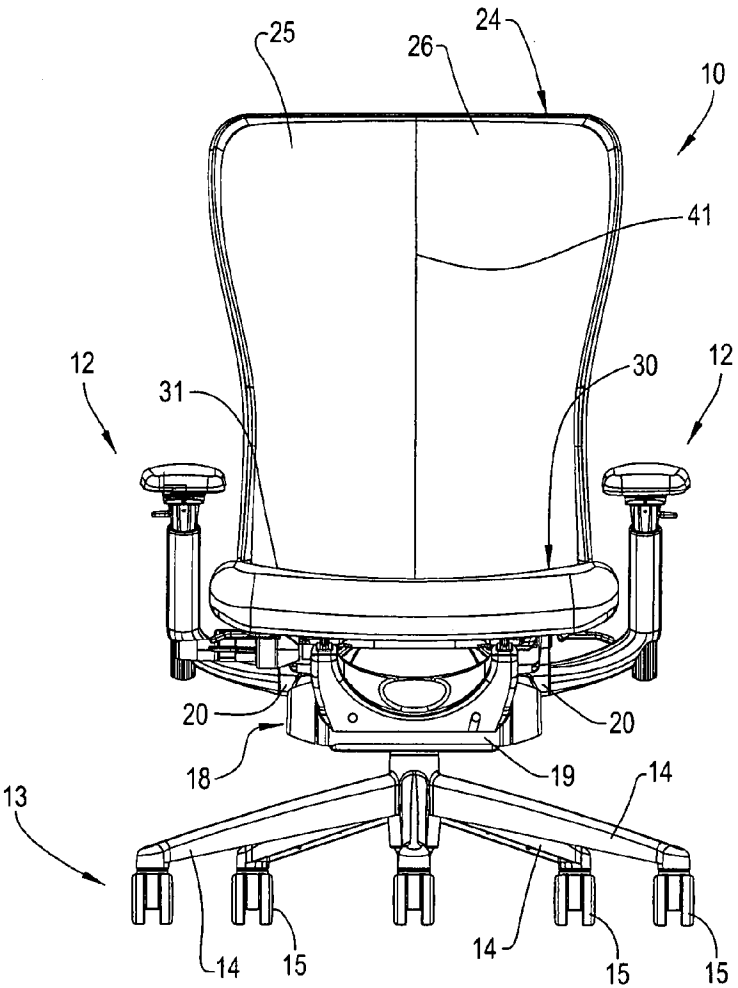
FIG. 1 is a front elevational view of an office chair having an inventive back assembly arrangement.
Figure 4:
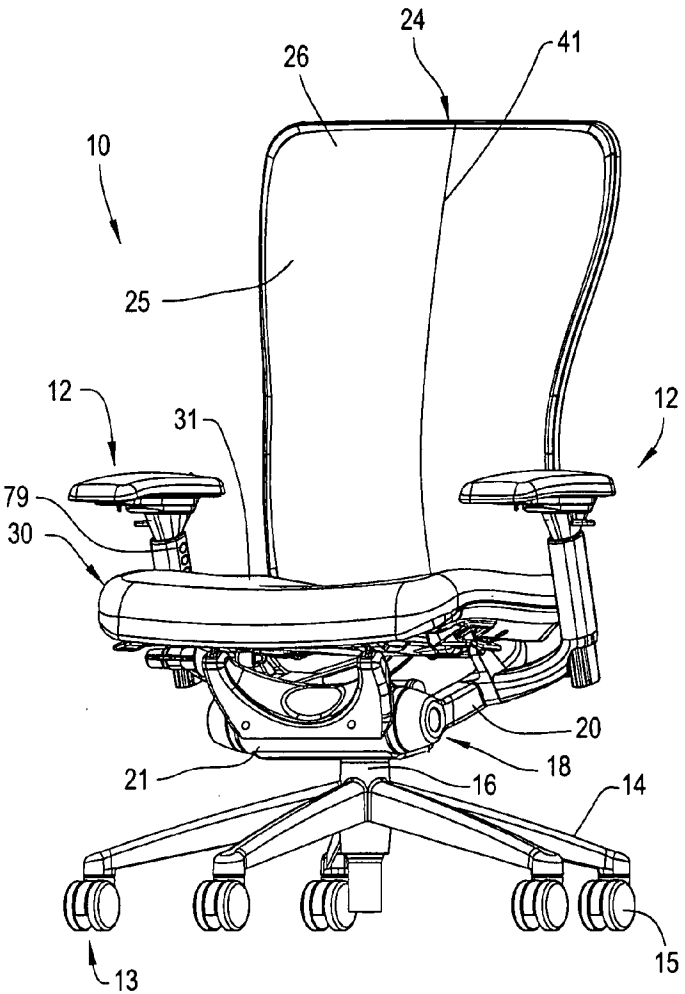
FIG. 4 is a front isometric view thereof.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIGS. 1-4, the invention generally relates to an office chair 10 which includes various inventive features therein which accommodate the different physical characteristics and comfort preferences of a chair occupant and also improve the assembly of the chair 10.

Generally, this chair 10 includes improved height-adjustable arm assemblies 12 which are readily adjustable. The structure of each arm assembly 12 is disclosed in U.S. patent application Ser. No. 60/657,632, entitled ARM ASSEMBLY FOR A CHAIR, which is owned by Haworth, Inc., the common assignee of this present invention. The disclosure of this patent application is incorporated herein in its entirety by reference.

The chair 10 is supported on a base 13 having radiating legs 14 which are supported on the floor by casters 15. The base 12 further includes an upright pedestal 16 which projects vertically and supports a tilt control mechanism 18 on the upper end thereof. The pedestal 16 has a pneumatic cylinder therein which permits adjustment of the height or elevation of the tilt control mechanism 18 relative to a floor.

The tilt control mechanism 18 includes a control body 19 on which a pair of generally L-shaped uprights 20 are pivotally supported by their front ends. The uprights 19 converge rearwardly together to define a connector hub 22 on which is supported the back frame 23 of a back assembly 24 the structure of which is disclosed in U.S. patent application No. 60/657,313 entitled CHAIR BACK which is owned by Haworth, Inc. The disclosure of this patent application is incorporated herein in its entirety by reference. The structure of this tilt control mechanism is disclosed in U.S. patent application Ser. No. 60/657,541, entitled TILT CONTROL MECHANISM FOR A CHAIR, and U.S. patent application Ser. No. 60/657,524, entitled TENSION ADJUSTMENT MECHANISM FOR A CHAIR, which applications are owned by Haworth, Inc. The disclosure of each of these patent applications is incorporated herein in its entirety by reference.

The back assembly has a suspension fabric 25 supported about its periphery on the corresponding periphery of the frame 23 to define a suspension surface 26 against which the back of a chair occupant is supported.

To provide additional support to the occupant, the back assembly 24 also includes a lumbar support assembly 28 which is configured to support the lumbar region of the occupant's back and is adjustable to improve the comfort of this support. The structure of this lumbar support assembly 28 and pelvic support structure is disclosed in U.S. patent application Ser. No. 60/657,312, entitled CHAIR BACK WITH LUMBAR AND PELVIC SUPPORTS, which is also owned by Haworth, Inc. The disclosure of this patent application is incorporated herein in its entirety by reference.

Additionally, the chair 10 includes a seat assembly 30 that defines an upward facing support surface 31 on which the seat of the occupant is supported.

Figure 6:
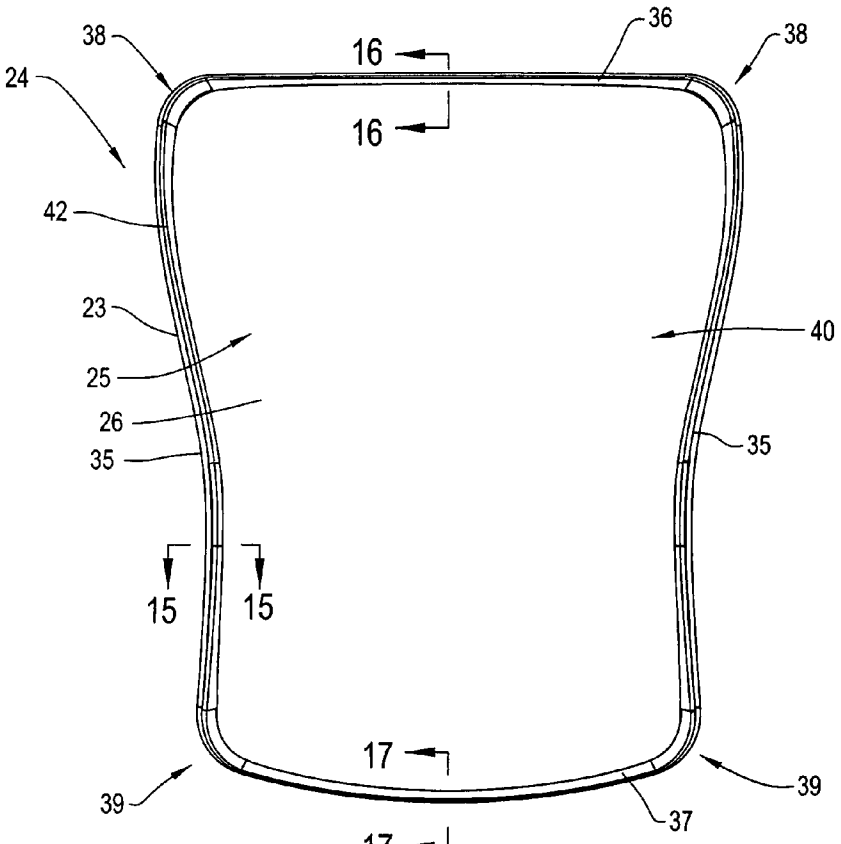
FIG. 6 is a front view thereof.
Figure 5:
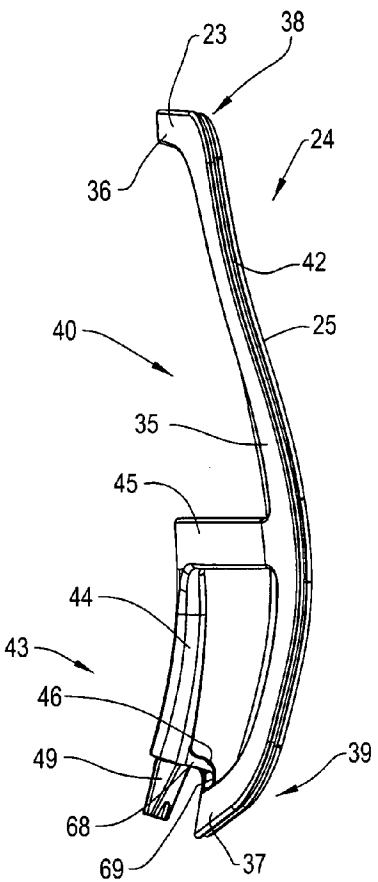
FIG. 5 is a side view of a back assembly.
Figure 7:
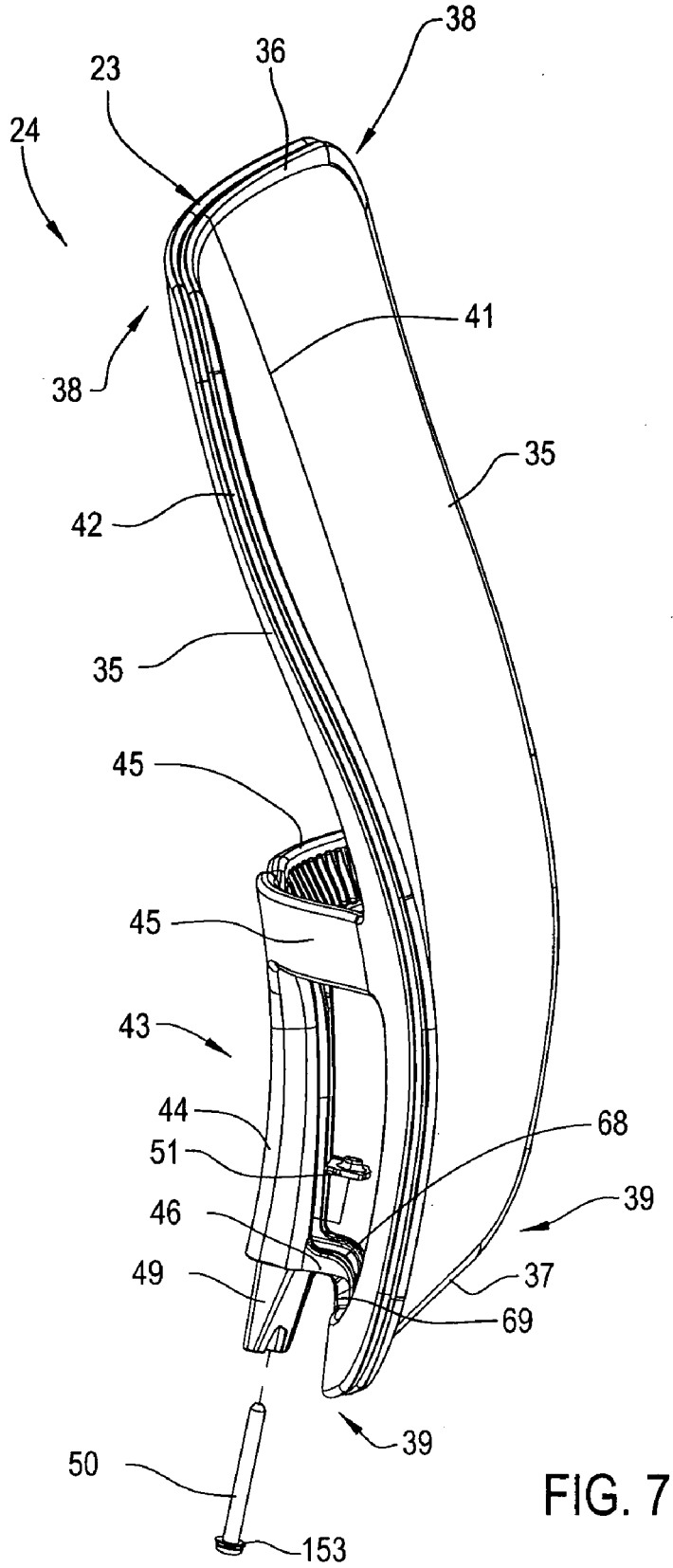
FIG. 7 is an exploded isometric view of the back assembly with a fastener for mounting the back frame on the tilt control mechanism of the chair.
Figure 8:
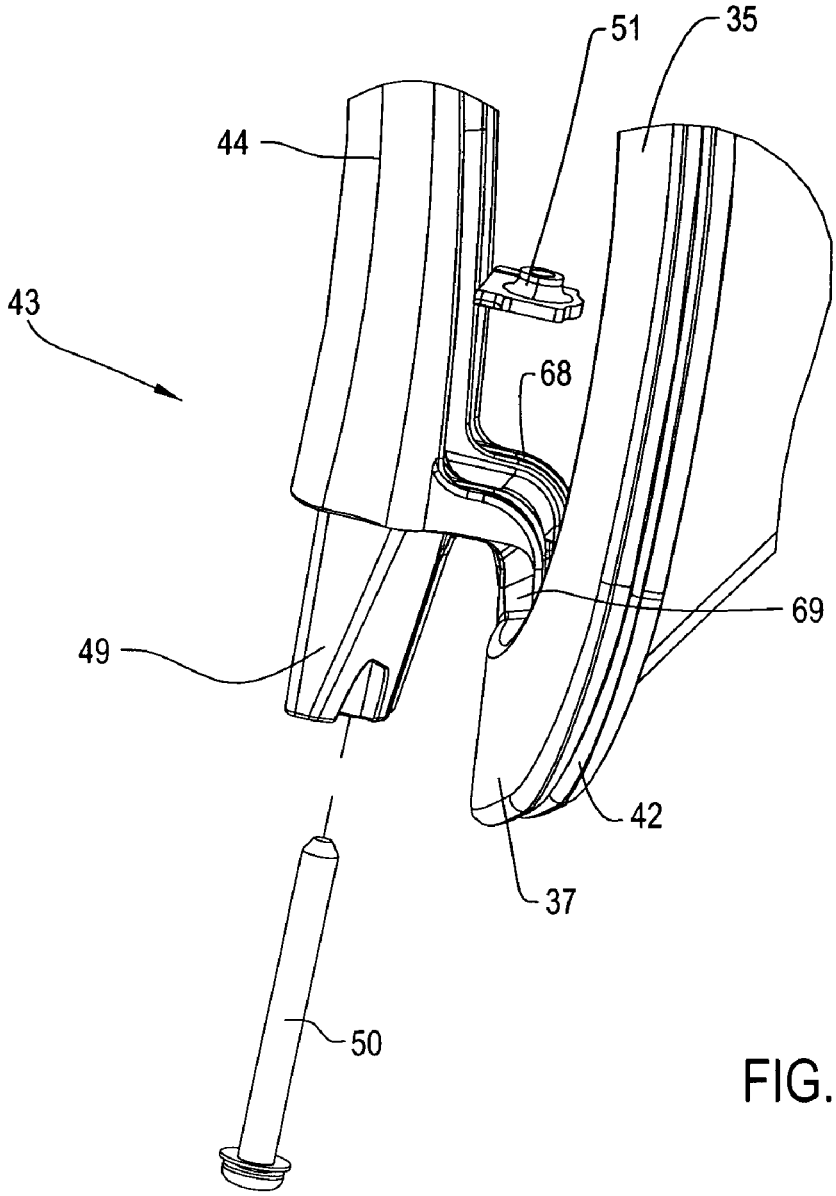
FIG. 8 is an enlarged exploded view of the mounting section of the back frame.

More particularly as to the back assembly 24, the back assembly 24 is generally illustrated in FIGS. 5-7. The back frame 23 comprises a pair of vertical side frame rails 35, a top frame rail 36, and a bottom frame rail 37 which are joined together at the upper corners 38 of the back assembly 24 as well as the lower corners 39 to define an annular or endless frame having a central opening 40.

As can be seen in FIGS. 5-7, the back frame 23 has a contoured shape which ergonomically supports the back of the user. In particular, the side rails 35 curve backwardly as seen in FIGS. 5 and 7 as well as outwardly (FIG. 6) relative to the bottom portions of the side rails 35. Further, the top rail 36 and bottom rail 37 each have a respective curvature to closely conform to the curvature of a typical chair occupant.

To support the occupant, the back assembly 24 includes the suspension fabric 25 which is secured taughtly on the frame. Specifically, the back frame 23 includes a peripheral securement channel 42, in which is fixed the peripheral edge 25A of the suspension fabric 25 as will be discussed in further detail herein.

The back frame 23 also generally includes a monolithic support structure 43 to which the side rails 35 and bottom rail 37 are rigidly interconnected. This support structure 43 comprises an upright support column 44 which extends along the chair centerline 41 (FIG. 7) to an elevation located just below the middle of the side rails 35. The upper end of the support column 44 includes a pair of support arms 45 which extend sidewardly and have each respective outer end connected rigidly to one of the side rails 35.

The lower end of the support column 43 includes a generally L-shaped connector flange 46 (FIGS. 5 and 7) which projects forwardly and then downwardly into fixed engagement with the lower cross rail 37. Still further, this lower column end includes a bayonet connector 49 which projects downwardly for rigid connection to the uprights 20 by fastener bolt 50 and nut 51 as will be described in further detail hereinafter.

Figure 9:
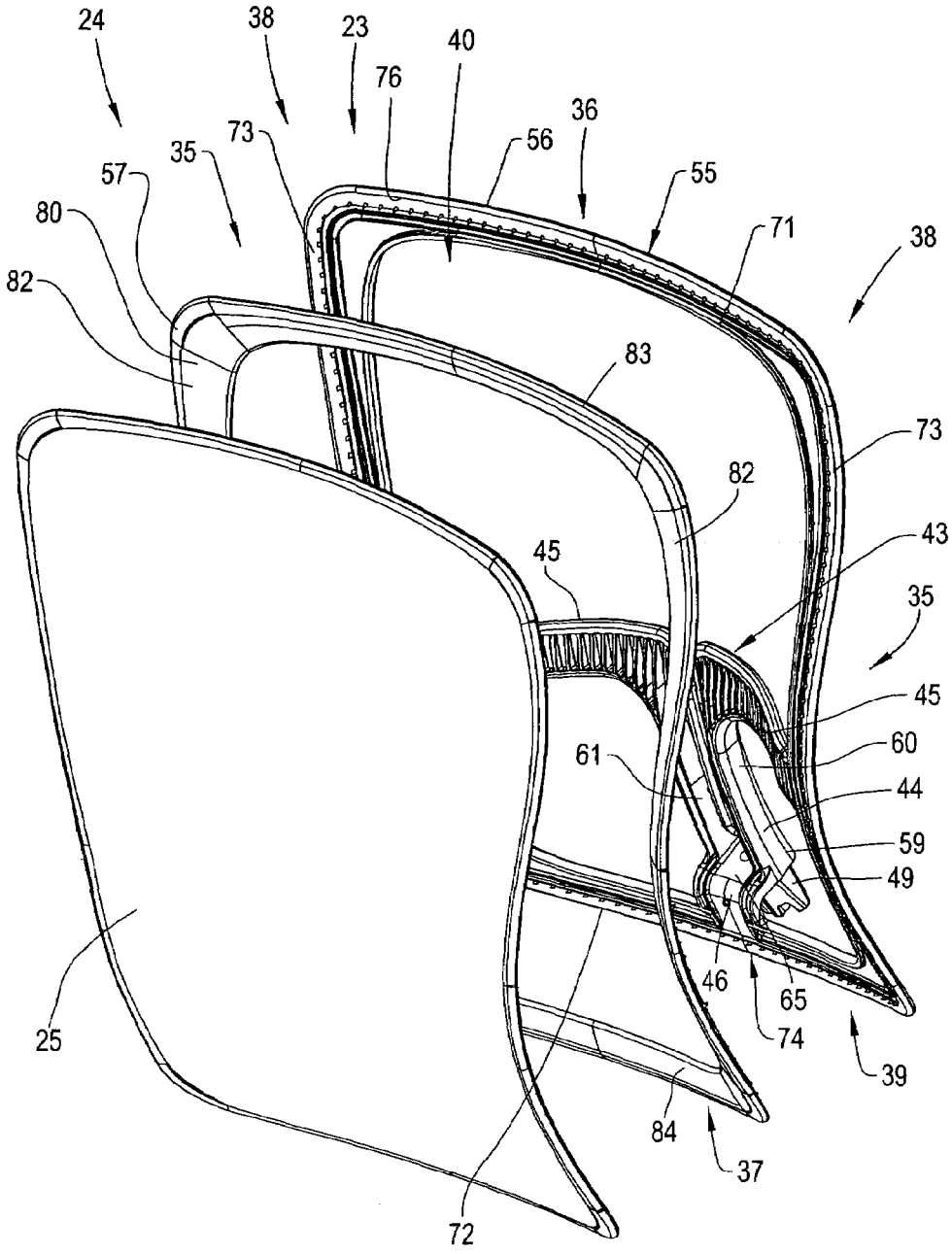
FIG. 9 is an exploded isometric view of the back components forming the back assembly.

Referring more particularly to the components of the back assembly 24, FIG. 9 illustrates these components in an exploded view thereof. In particular, the frame 23 comprises a molded rear frame unit 55 that includes the support structure 44 described above as well as a rear frame ring 56 which is supported on the support arms 45 of the support structure 44. The back frame 24 further includes a molded front frame ring 57 which is adapted to be mounted to the rear frame ring 56 in overlying relation to define the channel 42 about the periphery thereof. Further, the back assembly 24 includes the above-described suspension fabric 25 which preferably is secured to the rear ring 56 within the channel 42 by ultrasonic welding or other attachment means like adhesives and mechanical fasters.

Figure 11:
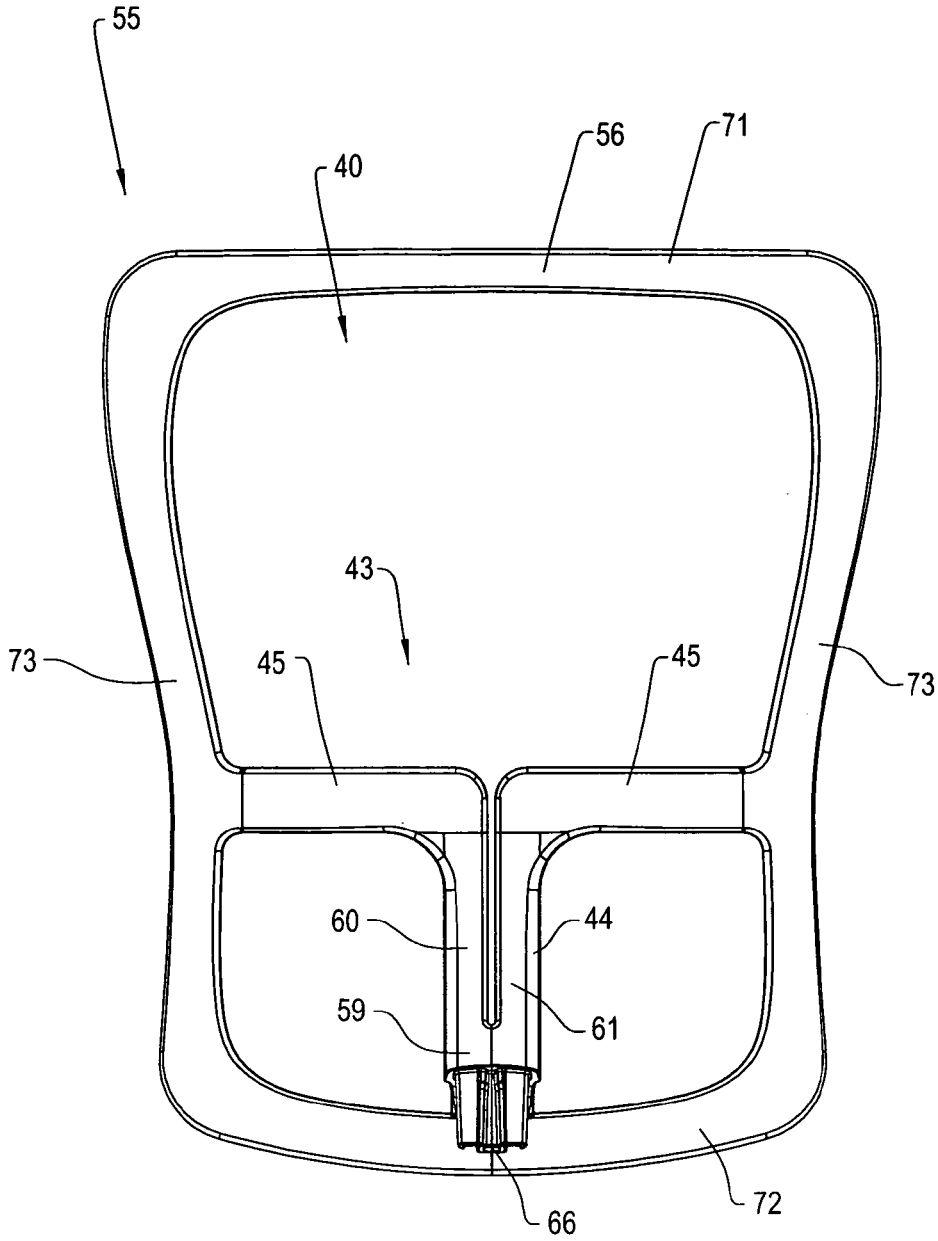
FIG. 11 is a rear exterior view of the back frame.
Figure 12:
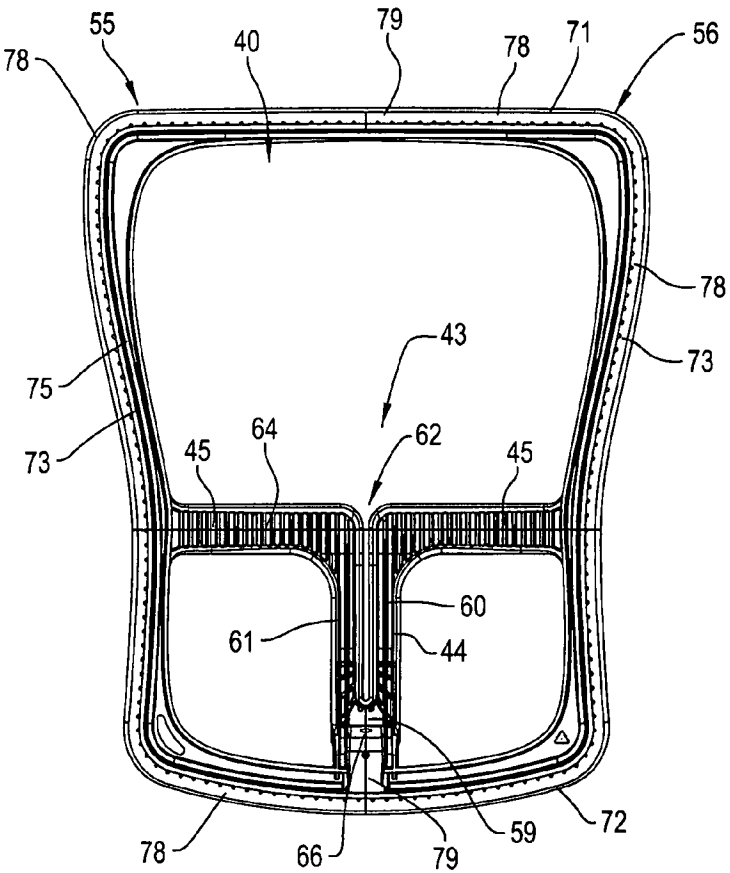
FIG. 12 is a front interior view of the back frame.

Referring to FIGS. 11 and 12, the rear frame unit 55 comprises the support structure 43 and the rear frame ring 56. Both the support structure 43 and the rear frame ring 56 are molded simultaneously together in a one-piece monolithic construction having the contoured shape described above. To facilitate molding of this contoured shape while still possessing the channel 42 mentioned above, the rear frame ring 56 and front frame ring 57 are molded separate from each other and then affixed together.

Turning to the support structure 43, the support column 44 thereof is located centrally within the lower half of the central frame opening 40. The support column 44 has a base end 59 and a pair of column halves 60 and 61 which are separated from each other by a vertically elongate column slot 62. The column 44 therefore is formed as a split column by the slot 62 which extends along a substantial portion of the length of the column 44 with the column halves 60 and 61 being joined together by the solid base section 59. As such, the column halves 60 and 61 are supported in cantilevered relation by the base section 59.

The rear frame unit 55 (FIGS. 9 and 12) and front frame ring 57 (FIGS. 9 and 13) are formed from a glass filled nylon material that is molded into the desired shapes wherein this material has limited flexure so as to permit flexing of the various areas of the frame when placed under load by a chair occupant. Since the column halves 60 and 61 are separated from each other by the slot 62, these column halves 60 and 61 may articulate independently of each other to facilitate flexing movement of the various frame corners 38 and 39.

The upper ends of the frame halves 60 and 61 join integrally to the transverse arms 45. The outer ends of the arms 45 extend outwardly and are molded integral with the vertical sides of the rear frame ring 56. As seen in FIG. 12, the inside faces of the column halves 60 and 61 and the support arms 45 have an appropriate pattern of ribbing 64 to selectively rigidify the support structure 43 while still permitting flexure thereof.

Figure 10:
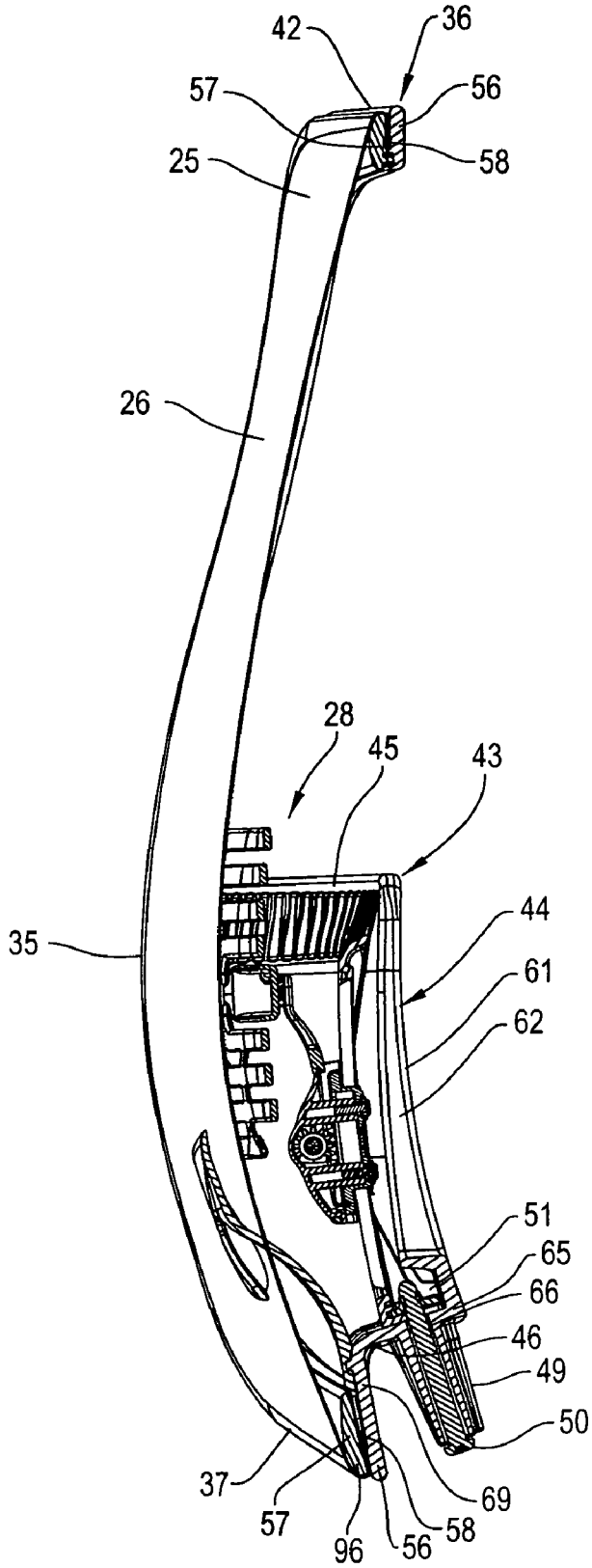
FIG. 10 is a side cross-sectional view of the back assembly as taken along the centerline of the back assembly.

In the column base 59, this column base 59 terminates at a bottom wall 65 (FIGS. 9, 10 and 12), which is formed with a bore 66 extending vertically therethrough. The bottom wall 65 further is formed integral with the bayonet connector 49 wherein the bore 66 extends vertically through this bottom wall 65 and the bayonet 49 as seen in FIG. 10. When joining the back frame 23 to the chair uprights 20, the fastener 50 extends upwardly from the uprights 20 as will be described in further detail herein and extends through the fastener bore 66 so that it projects vertically above the bottom column wall 65. The upper end of the fastener 50 is engaged by the threaded nut 51 as seen in FIG. 10 to thereby secure the back frame 23 to the uprights 20.

Further as to the bottom wall 65, this wall extends forwardly to define a horizontal leg 68 of the L-shaped flange 46, which flange 46 then turns downwardly to define a vertical leg 69 (FIGS. 5, 7 and 10). The bottom column section 59 serves to rigidly support the bottom cross rail 37 of the back frame 23. As such, the bottom frame rail 37 is more rigidly supported and has less relative movement under occupant loads than the middle frame areas supported by the support arms 45 or even the upper frame corners 38 which have the greatest amount of displaceability. In this manner, the rear frame unit 55 provides for controlled flexing of the entire back frame 23.

Figure 16:
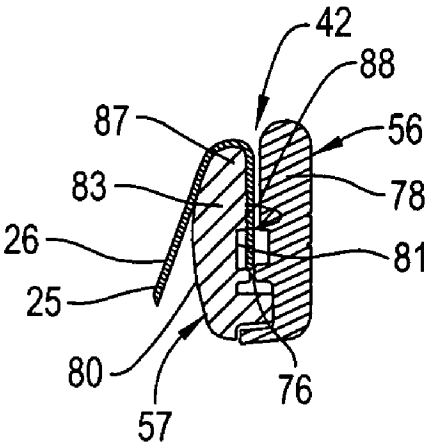
FIG. 16 is a side cross-sectional view of the top frame member as taken along line 16-16 of FIG. 6.
Figure 15:
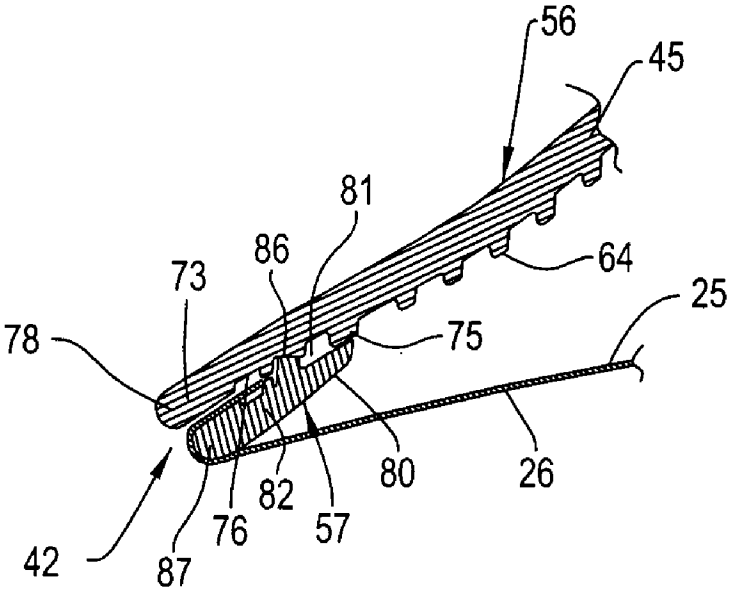
FIG. 15 is a top cross-sectional view of a side frame member as taken along line 15-15 of FIG. 6.
Figure 17:
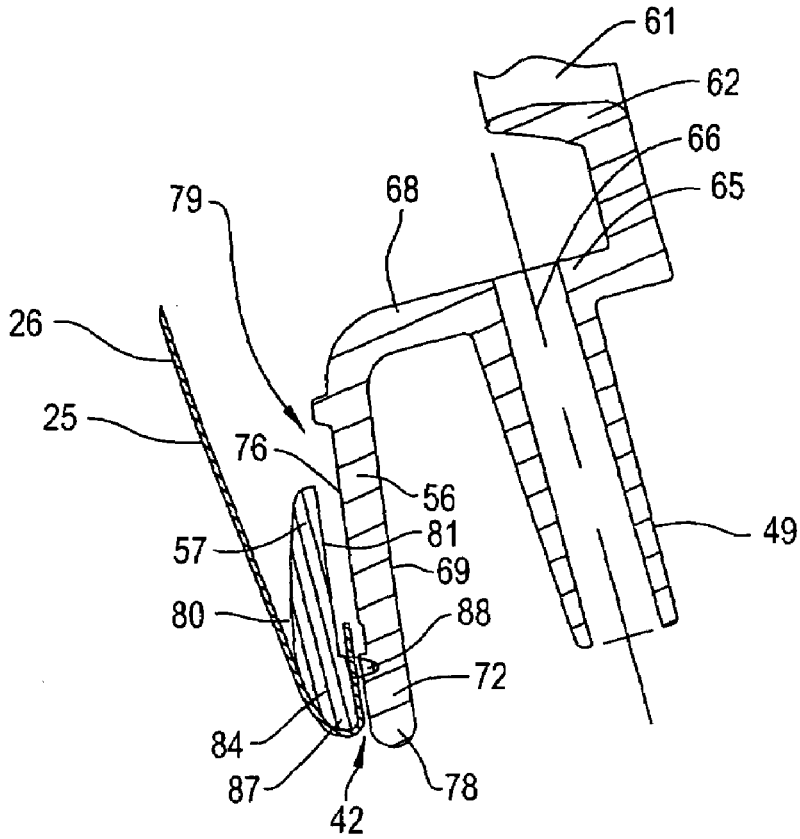
FIG. 17 is a side cross-sectional view of the bottom frame member as taken along line 17-17 of FIG. 6.

Referring to FIGS. 11 and 12, the rear frame ring 56 comprises top and bottom ring sections 71 and 72 and left and right ring sections 73 which extend vertically. As seen in FIG. 15, each side ring section 73 includes raised connector ribs 75 on the interior face 76 for ultrasonic welding to the front frame ring 57. The outer edge of the ring side section 73 includes a thinner portion 78 which extends continuously about the remaining ring sections 71-73 and essentially defines the rear side portion of the channel 42 as seen in FIGS. 16 and 17. As such, the interior face 76 of the frame ring 56 is adapted to contact opposing weld surfaces of the front frame ring 57.

In the middle of the lower ring section 72, a recessed pocket 79 is defined which opens upwardly and supports the pelvic support 29 therein.

Turning more particularly to the front frame ring 57 (FIG. 13), this frame ring 57 has a front face 80 which faces forwardly and a rear face 81 which faces rearwardly towards the rear frame ring 56 and is adapted to abut thereagainst and be fixedly secured thereto. This frame ring 57 is defined by vertical ring sections 82 and a top ring section 83 and a bottom ring section 84.

Figure 14:
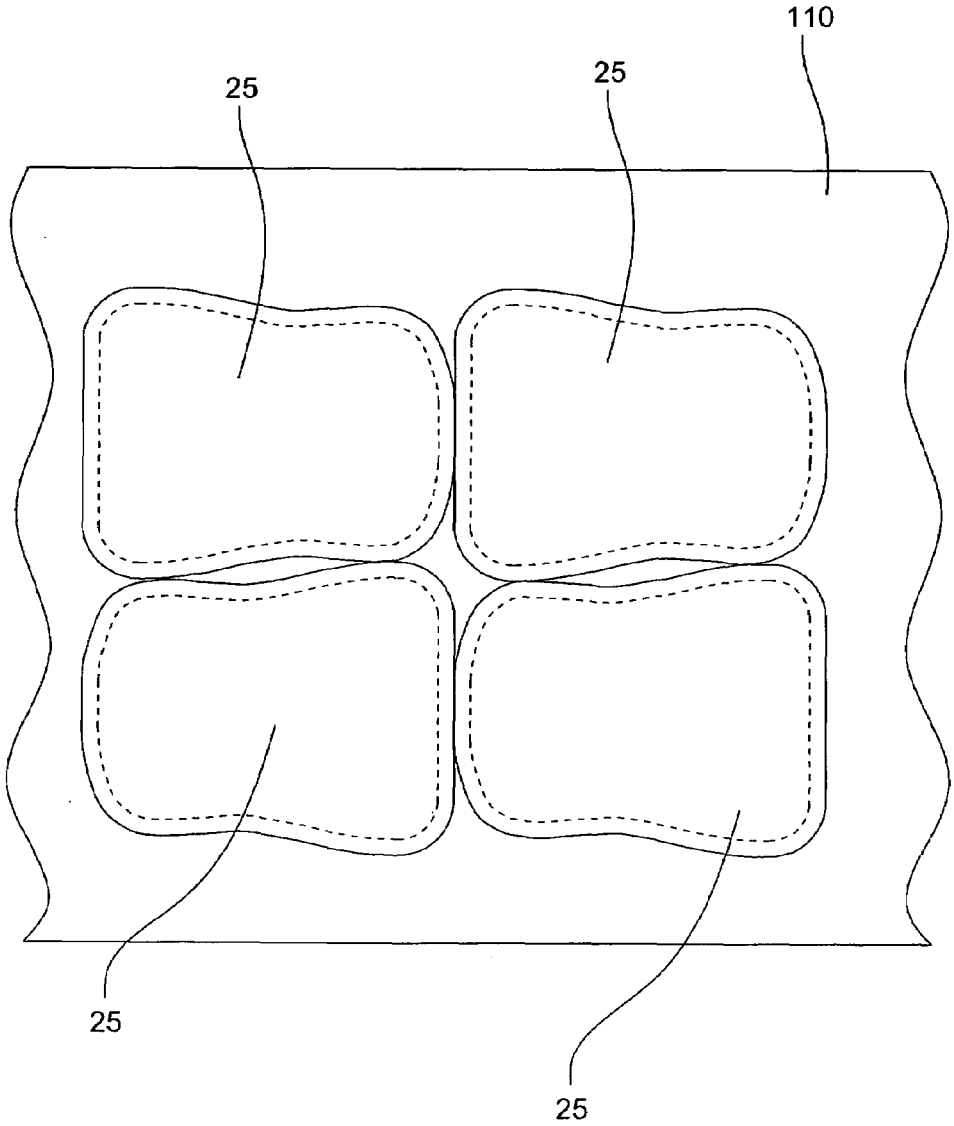
FIG. 14 is a diagrammatic view illustrating the manufacture of sheets of suspension fabric from a stock material.

As to the side ring sections 82 (FIG. 14), these ring sections 82 include a rearwardly projecting connector rib 86 adapted to abut against and be fixedly secured to the rear frame ring 56. Preferably, the front and rear frame rings 57 and 56 respectively are joined together by ultrasonic welding of these components with the faces disposed in contact being welded together. The outer edge portion 87 of the front ring 57 is disposed adjacent to but spaced apart from the other edge portion 78 to thereby define the entry portion of the channel 42.

In this manner, the rear frame ring 56 defines a rear portion of the channel 42 while the front frame ring 57 defines a front portion thereof which said frame rings 56 and 57 when disposed in opposing relation define the channel 42 so that it opens radially outwardly such that the fabric edge 25A may be received in non-removable engagement. To secure the fabric edge 25A in place, at least the outer ring edge 87 includes peripherally spaced apart "sharks teeth" or connector barbs 88 which engage or pierce the fabric 25. Additionally, the barbs 88 contact the interior frame face 76 of the rear ring 56 to further facilitate sonic welding of the frame rings 56 and 57.

Before joining the frames 56 and 57, the fabric edge 25A is first sonically welded to the interior frame face 81, preferably in the region between the barbs 88 and the rib 86. This securely fastens the fabric 25 in place, after which the frame rings 56 and 57 are joined together.

In this manner, the suspension fabric 25 is tightly fitted onto the back frame 23 so that the fabric material 25 is stretched taut. As generally illustrated in FIGS. 10 and 15-17, the fabric 25 then angles away from the back frame 23 and spans the central frame opening 40.

Figure 13:
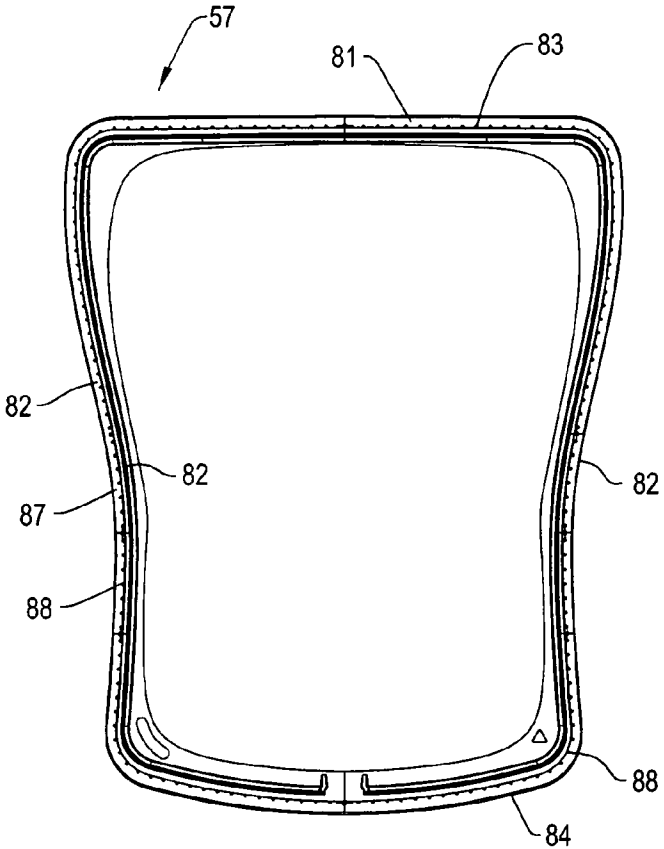
FIG. 13 is a rear interior view of the front frame.

The suspension fabric 25 is formed of any suitable suspension material which preferably is elastomeric and preferably has an open weave that provides for breathability. FIG. 13 generally illustrates the formation of the pieces of suspension fabric 25 wherein FIG. 13 illustrates an initial stock material 110 from which is cut multiple pieces of the suspension fabric 25. The suspension fabric 25 preferably is formed as a single layer but may have multiple overlying layers and may also include cushioning included therein.

Generally, the back frame 24 is assembled by first joining the fabric 25 to the front frame ring 57 by ultrasonic welding through the process described hereinafter. During this attachment process, the suspension fabric 25 is resiliently stretched over the front frame ring 57 with the peripheral edge 25A of the fabric 25 being embedded or enclosed within the channel 42.

Figure 18:
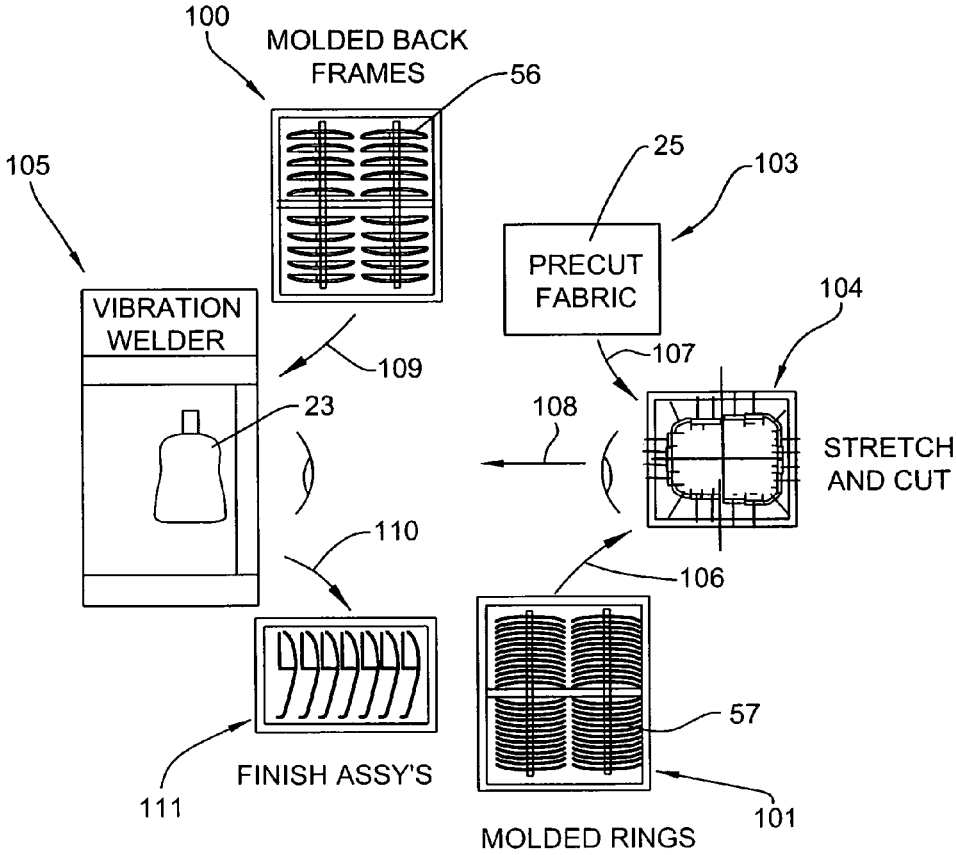
FIG. 18 is a diagrammatic view of the assembly process for manufacturing a chair frame according to the invention.

Referring to FIG. 18, the assembly process is diagrammatically illustrated. Initially, a stock of back frame rings 56 are provided typically as a frame unit 55. These back frame rings 56 are provided in storage area 100, while a similar stock of front frame rings 57 are provided in storage area 101. Another stock of fabric sheets 25 are provided in area 103.

To assemble these components, a stretch and wrap assembly machine 104 is provided along with an ultrasonic welder 105. In these machines, the front frame ring 57 and fabric 25 are positioned in the machine 104 as indicated by arrows 106 and 107, and the assembly machine 104 is then used to stretch the fabric 25, clamp. this fabric 25 on the front frame ring 57 and then wrap and attach the fabric edge 25A to the peripheral edge region 87 of the ring 57. This front frame sub-assembly is then transported to the welder 105 (arrow 108) along with a back frame ring 56 (arrow 109) where the front frame sub-assembly is attached to the rear frame ring 56 to form the back frame 23. The finished back frame 23 is then transported at arrow 110 to a finished stockpile 111 for subsequent assembly to the chair 10.

Figure 19:
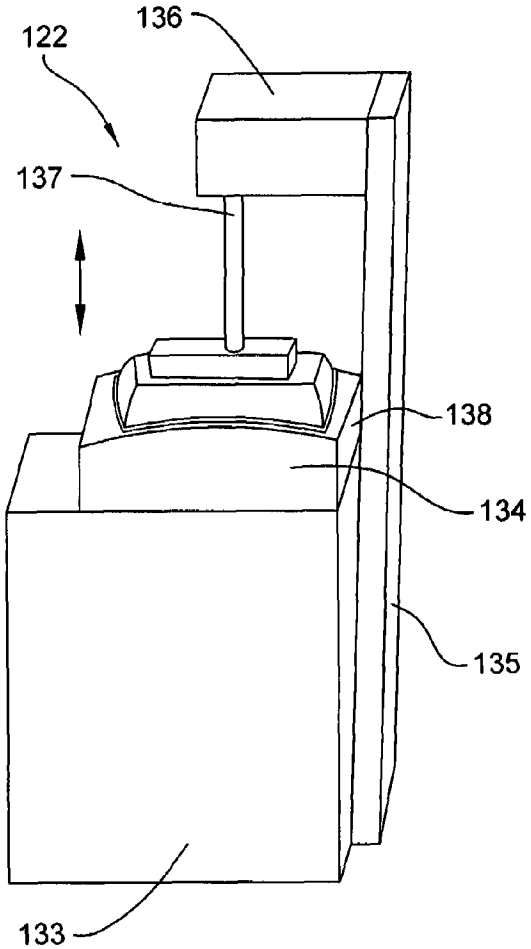
FIG. 19 is a perspective view of an assembly machine for securing the fabric to back frame.
Figure 19:
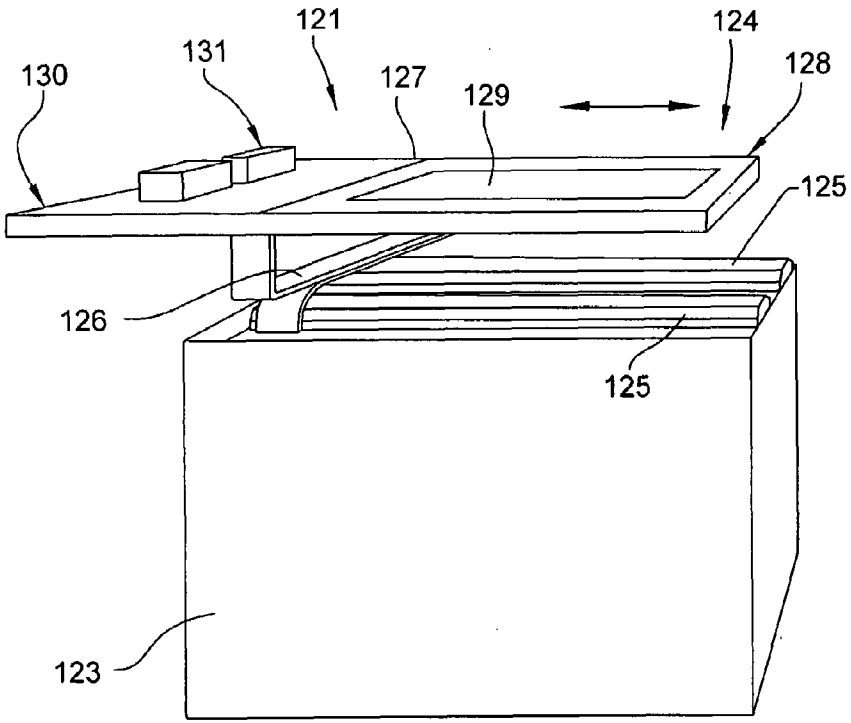
Figure 20:
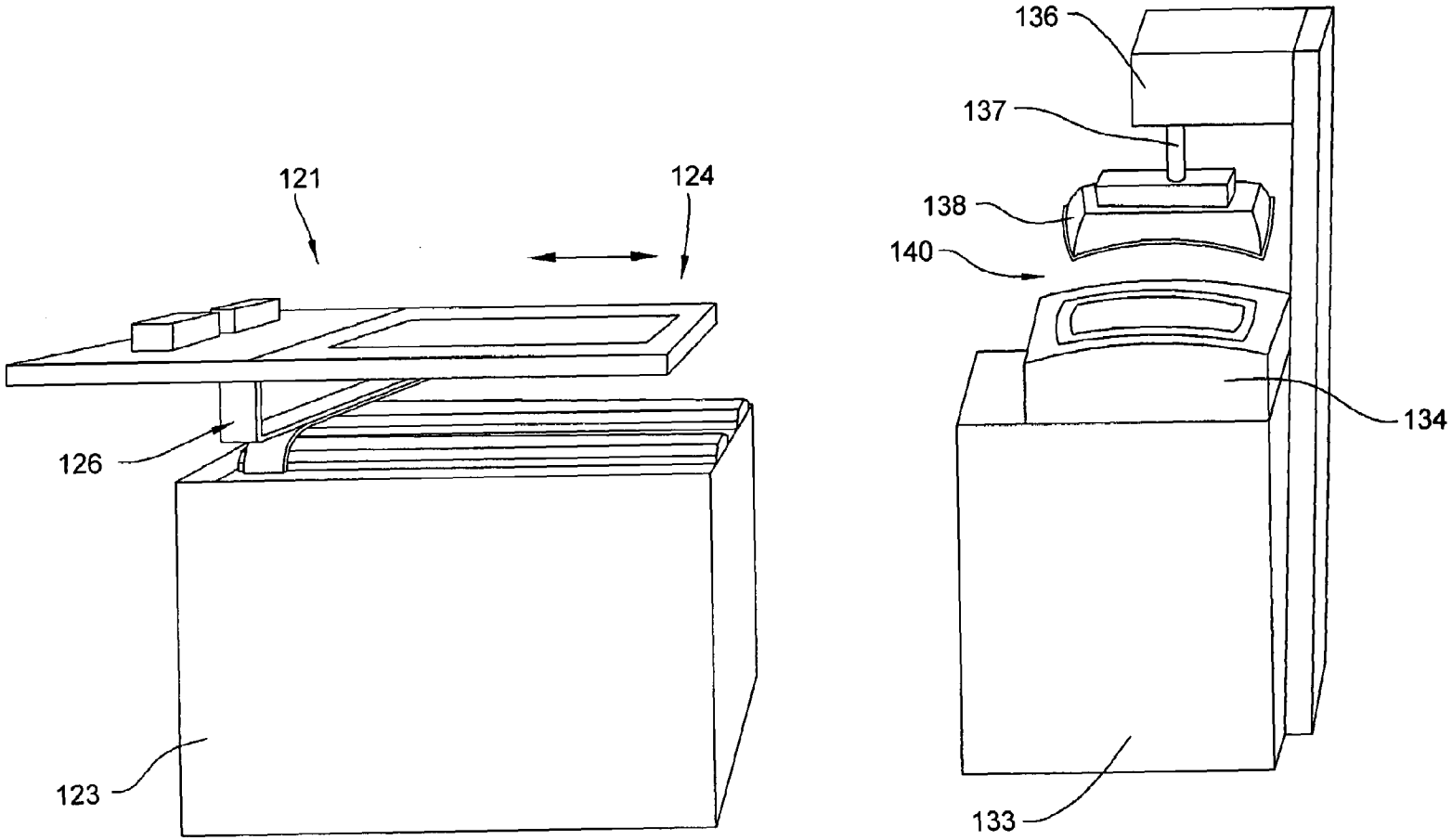
FIG. 20 is a perspective view of the assembly machine with a clamping head in a raised position.

The following description is directed to the assembly machine 120 which generally comprises a stretching unit 121 and a wrapping unit 122 as seen in FIGS. 19 and 20. The stretching unit 121 includes a stationary base 123 on which is supported a shuttle 124. The shuttle 124 includes a clamp system thereon for clamping and stretching the fabric 25 and is also sidewardly movable to position the stretched fabric 25 within the wrapping unit 122.

In this regard, the base 123 includes a pair of horizontal guide rails 125 which support a slidable carriage 126 thereon. An upper stretcher frame 127 is rigidly supported on the carriage 126 so as to move in unison therewith. The forward end 128 of the frame 127 includes an opening 129 in which the fabric 25 will be supported and is cantilevered from the carriage 126 so as to extend beyond the base 123 and be able to position the fabric 25 in the middle of the wrapping unit 122.

The opposite rearward end 130 includes a pneumatic control system 131 for operating the stretching operation as will be described in further detail herein.

As to the wrapping unit 122, this unit 122 includes a base 133 on which is supported a contoured bottom nest 134 for supporting the front frame section 57 therein. The base 133 supports an upright column 135 on which a support head 136 is provided. This support head includes a vertical shaft 137 on the lower end of which is supported a clamping body or head 138. As seen in FIG. 20, this support head 136 drives the shaft 137 vertically to raise and lower the clamping body 138.

When in the raised position of FIG. 20, the shuttle 124 is able to move sidewardly into the space 140 defined between the clamping body 138 and the bottom nest 134. As described herein, this allows the fabric to be positioned between the clamping body 138 and bottom nest 134 wherein a front frame section 57 would be positioned onto the bottom of the clamping body 138 and temporarily held in place thereon. In this manner, the clamping head 138 is driven downwardly to press the frame section 57 against the upward facing surface of the fabric 25 and continues to press this downwardly to the fully clamped position illustrated in FIG. 19. As will be described herein, the fabric 25 will then be fixedly secured to the front frame section 57 while the clamping body 138 maintains the fabric 25 in the stretched condition.

Figure 21:
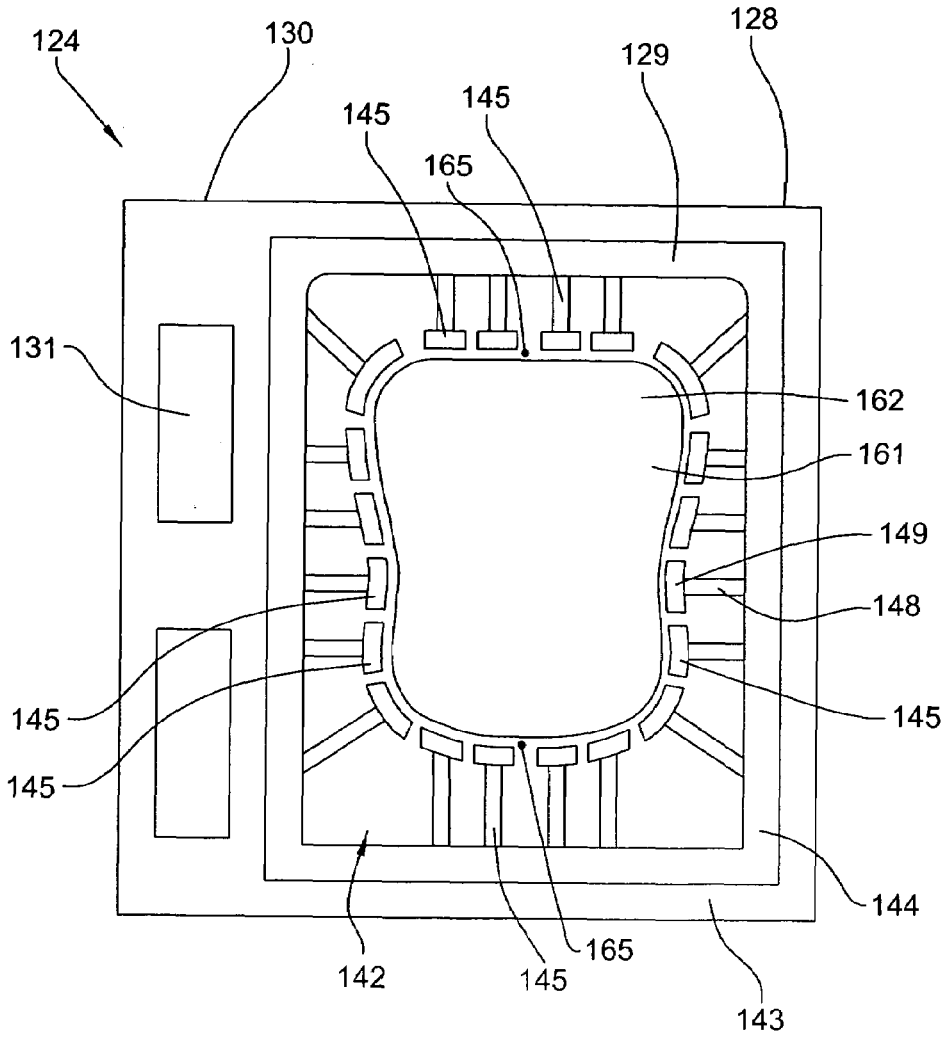
FIG. 21 is a plan view of a stretching machine forming part of the assembly machine.

Referring to FIG. 21, the shuttle includes a clamping arrangement 142 within the frame opening 129. More particularly, the shuttle comprises a peripheral rigid frame 143 (FIGS. 21 and 22) which defines said opening 129. This opening 129 is partially enclosed by a peripheral support wall 144 which projects a partial distance inwardly into the frame opening 129. This opening 129 is sized to fit a sheet of fabric 25 along with the clamping arrangement 142.

More particularly, the clamping arrangement 142 comprises the plurality of peripheral clamp assemblies or stretchers 145 which extend inwardly into the opening 129 and are adapted to grip substantially the entire peripheral fabric edge 25A. These clamp assemblies 145 each include a pneumatic cylinder 146 which is pivotally connected to the frame 143 by a support bracket 147. The pneumatic cylinder includes a horizontally extending cylinder shaft 148 on which is supported a jaw assembly 149 that is adapted for engagement with fabric edge 25A.

The jaw assembly on each of the clamp assemblies 145 includes a fixed jaw 150 that is rigidly connected to the cylinder shaft 148 along with a removable clamping jaw 152 that has a cam lock 153 thereon. The cam lock 153 is adapted to engage through the fixed jaw 150 wherein rotation of the cam lock 153 draws the jaws 150 and 152 together to thereby clamp the fabric edge 25A therebetween. Each of the clamp assemblies 145 is disposed opposite to another corresponding clamp assembly 145 on the opposite side thereof such that each side of the fabric 25 is pulled by an equal number of sidewardly aligned jaw assemblies 149. This provides for equal stretching across the width and length of the fabric 25.

In addition to the foregoing clamping arrangement 142, a moveable support table 160 is provided which underlies the opening 129 and includes an upwardly projecting support block 161. This support block 161 includes an upward facing surface 162 which is adapted to provide vertical support to the fabric 25 when it is laid into the opening 129 at the beginning of the clamping operation.

Figure 22:
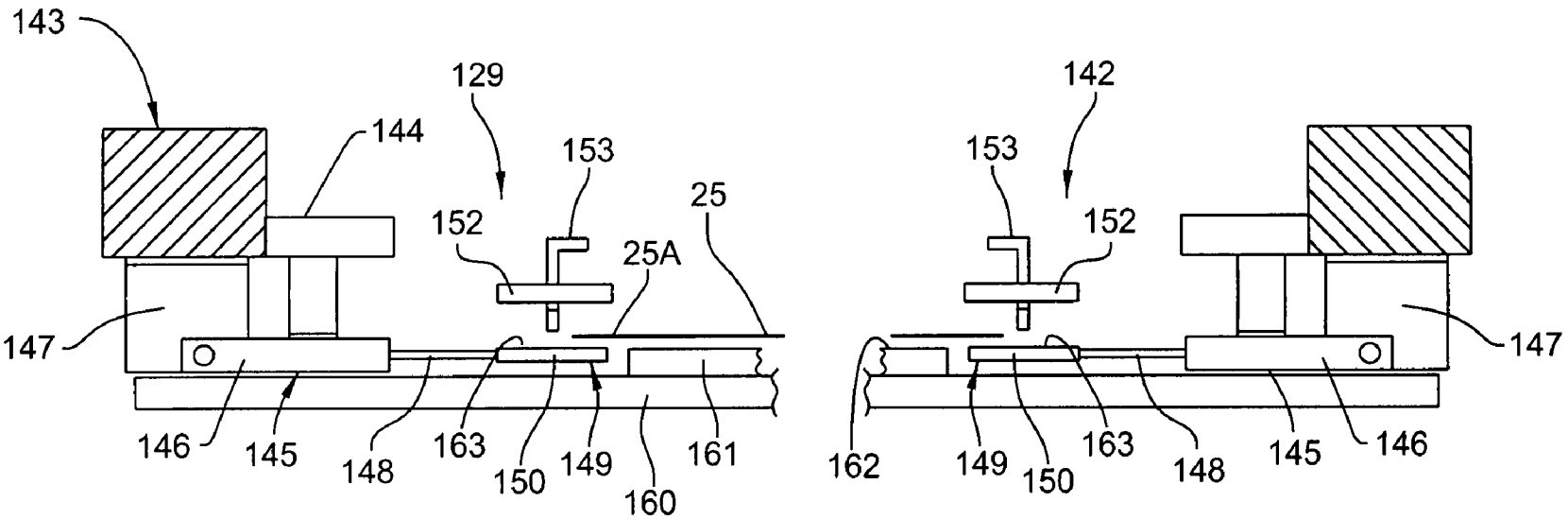
FIG. 22 is an enlarged side view illustrating a corresponding pair of clamp assemblies for stretching the fabric.

More particularly as to the clamping operation, this operation is performed by first raising the support table 160 upwardly to the support position illustrated in FIGS. 21 and 22. When in this position, the support surface 162 is located at substantially the same elevation as the upward facing jaw surfaces 163 on the fixed jaws 150. This provides a uniform flat surface on which the fabric 25 may be laid as seen in FIG. 22 wherein the fabric edge 25A overlaps only an outer portion of the fixed jaw 150. During this step, the upper jaw 152 has been removed to provide unimpeded access for laying of the fabric 25 in position. When laying the fabric in position, a pair of centered alignment pins 165 (FIG. 21) are provided wherein a corresponding marker on the fabric 25 aligns with these pins 165 and serves to center the fabric 25 in its desired position within the open area 129.

Figure 23:
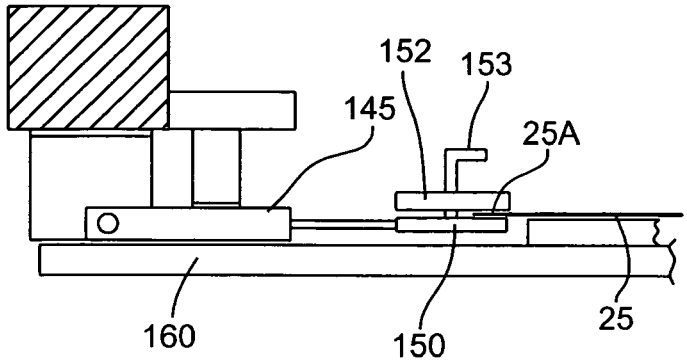
FIG. 23 is a partial side view of a clamp assembly clamping a peripheral fabric edge.

Thereafter, the jaws 152 are positioned over their associated fixed jaw 150 and the cam lock 153 is rotated to effect clamping of the fabric edge 25 as diagrammatically illustrated in FIG. 23. In this position the fixed jaw 150 is supported vertically by the table 160 in a generally horizontal orientation wherein the jaw 150 is also slideable along the table 160.

Figure 24:
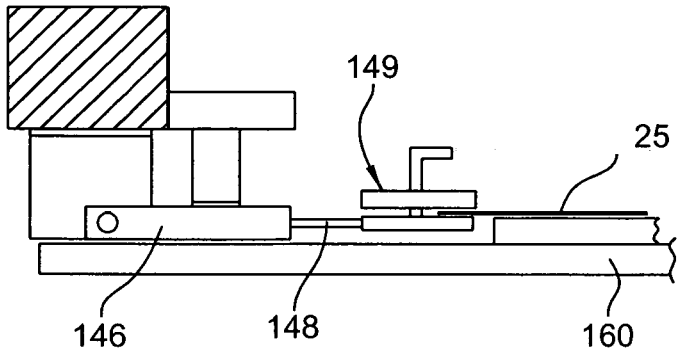
FIG. 24 illustrates the clamp assembly displaced sidewardly to stretch the fabric.
Figure 25:
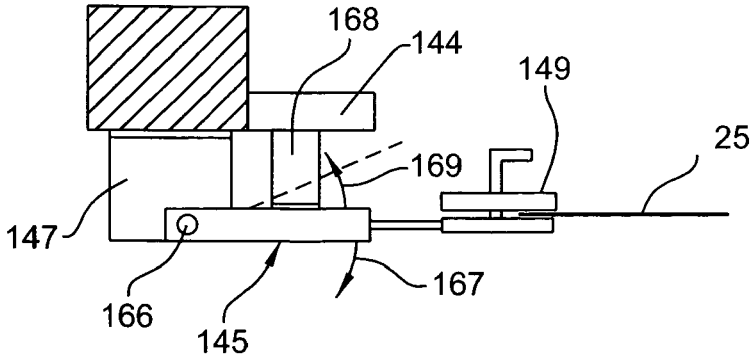
FIG. 25 illustrates the clamp assembly with a fabric support table removed therefrom.

As seen in FIG. 24, the fabric 25 is then stretched by actuating the pneumatic cylinder 146 to pull or retract the cylinder rod 148 and thereby displace the jaw assembly 149 sidewardly or outwardly away from its associated jaw assembly 149. In this manner, the associated pairs of jaw assemblies 149 serve to stretch the fabric 25 both sidewardly and longitudinally. The jaw assemblies 145 are independently controlled by the control unit 131 wherein each pair of jaw assemblies 149 may be displaced different distances to provide different tension levels within various areas of the fabric. In this regard, the upper portion of the fabric may have a desired tension which is somewhat looser than the tension located lower down in the fabric area.

Once the fabric 25 is stretched as seen in FIG. 24, the table 160 is then displaced downwardly such that the jaw assemblies 149 are no longer vertically supported by this table 160. Since each clamp assembly 145 is pivotally connected to its associated bracket 147 by a pivot connector 166, the clamp assembly 145 may tend to pivot downwardly as indicated by reference arrow 167. In this regard, the wall 144 also includes a downwardly projecting holding cradle 168 for each of the clamp assemblies 145. In this regard, each clamp assembly 145 is pivoted upwardly as indicated by reference arrow 169 and then snapped into its associated cradle 168 to maintain the fabric 25 in a generally elevated or at least a horizontally flat condition. In this manner, the fabric 25 is fully stretched and is now in position to be transferred to the wrapping unit 122 by sideward displacement of the shuttle 124.

During this transfer operation, the clamping body 138 of the wrapping unit 122 is in the raised position of FIG. 20 such that the open space 140 is defined between this clamping body 138 and the bottom nest 134. The shuttle 124 is shifted sidewardly and generally disposed between the clamping body 138 and the bottom nest 134 as diagrammatically illustrated in FIG. 29. In this regard, the stretched fabric 25 overlies the bottom nest 134 and is in a taut condition. Generally, the additional front frame section 57 is positioned above the fabric 25 and then fixedly held onto the clamping body 138 after which the frame section 57 is pressed downwardly against the fabric 25.

Figure 26:
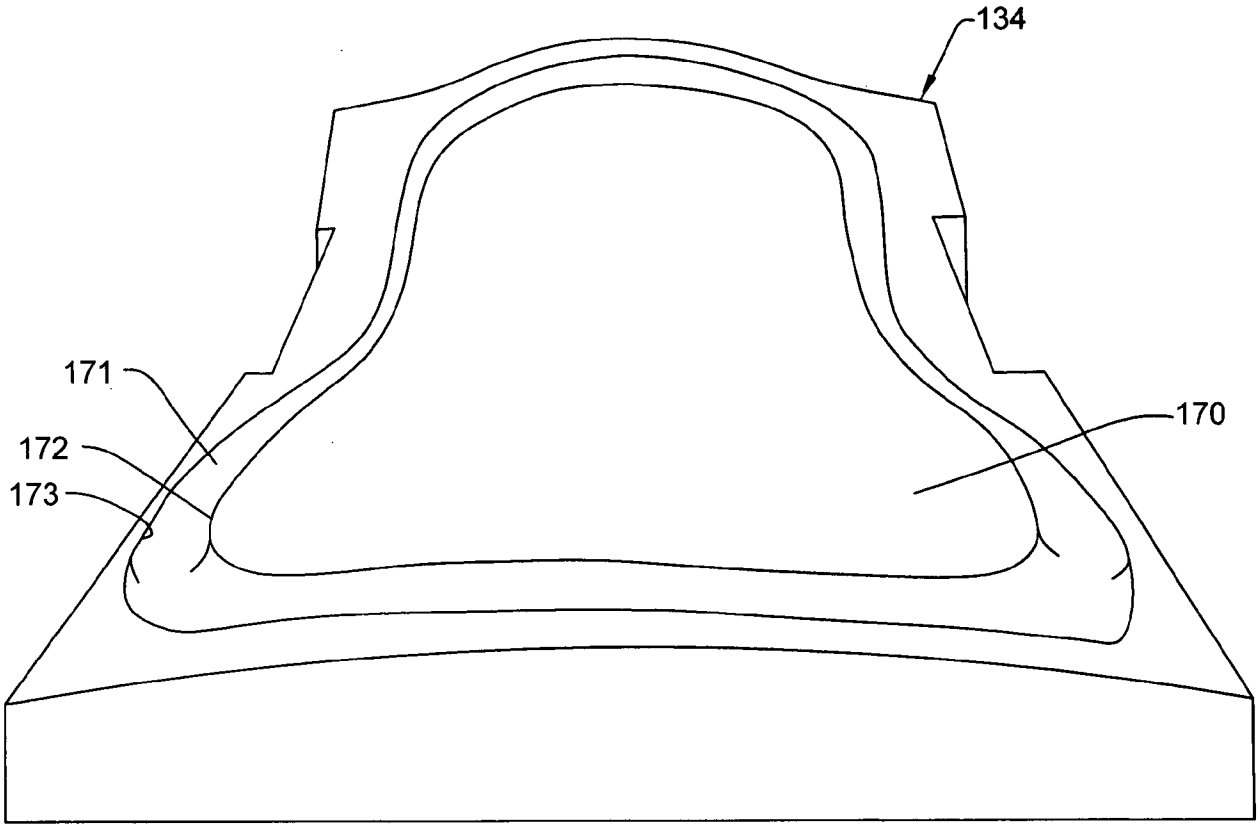
FIG. 26 illustrates a bottom nest of the wrapping machine which forms part of the attachment machine.
Figure 27:
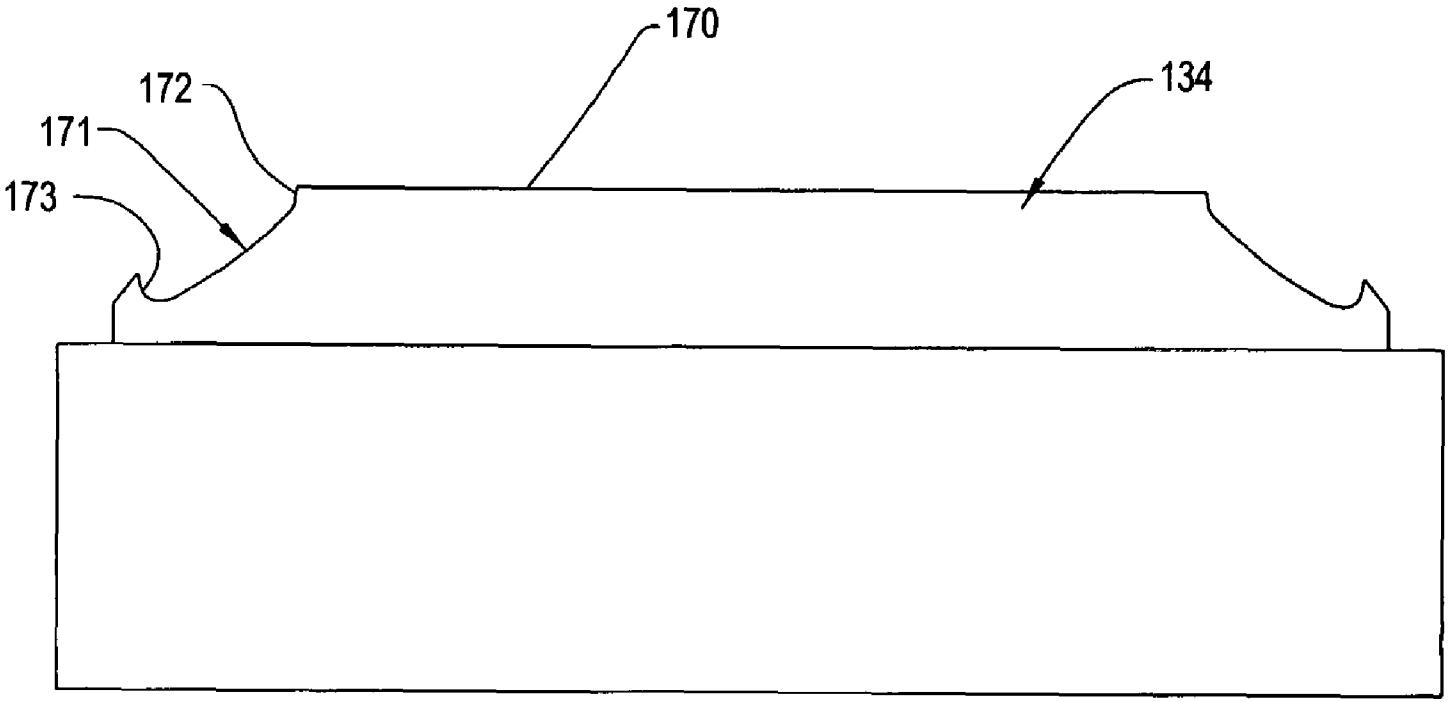
FIG. 27 is a side view of the lower nest.
Figure 28:
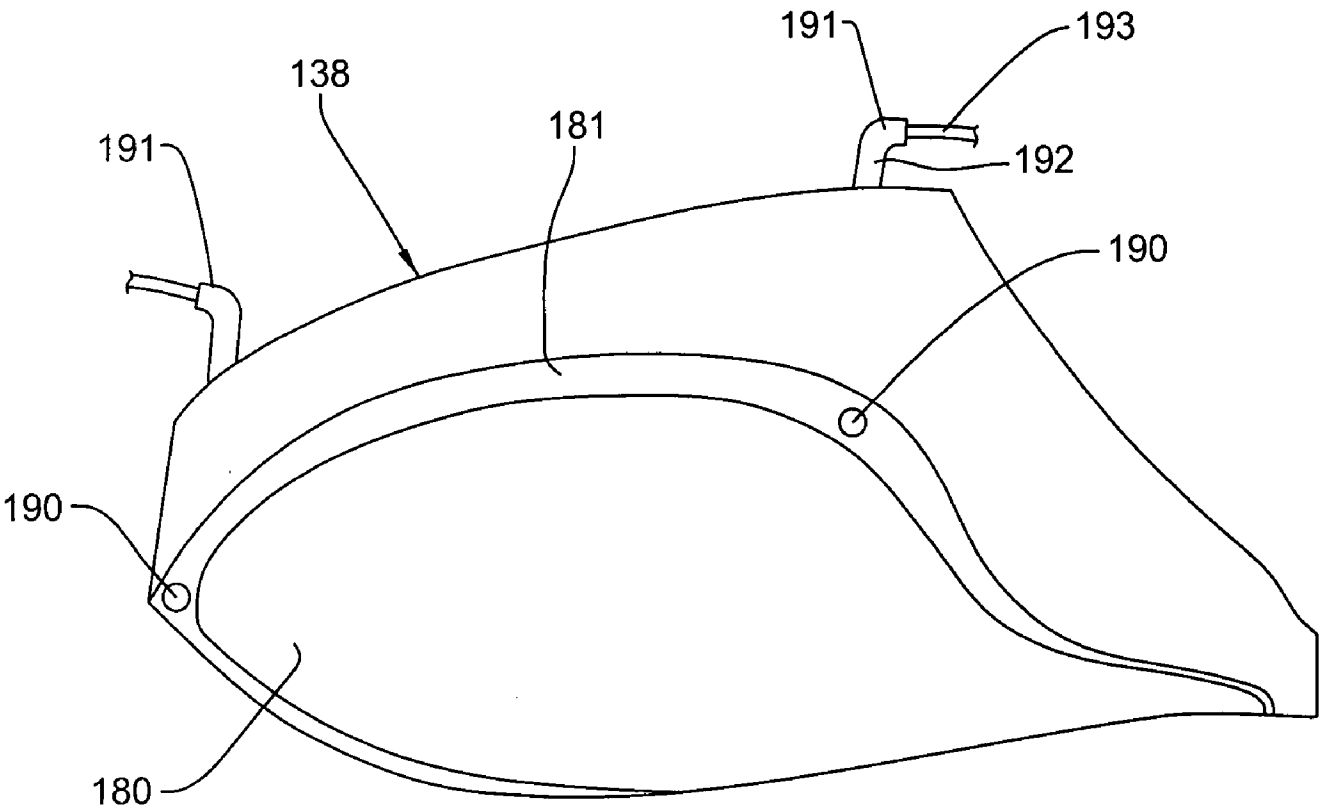
FIG. 28 is a bottom perspective view of the clamping head.
Figure 30:
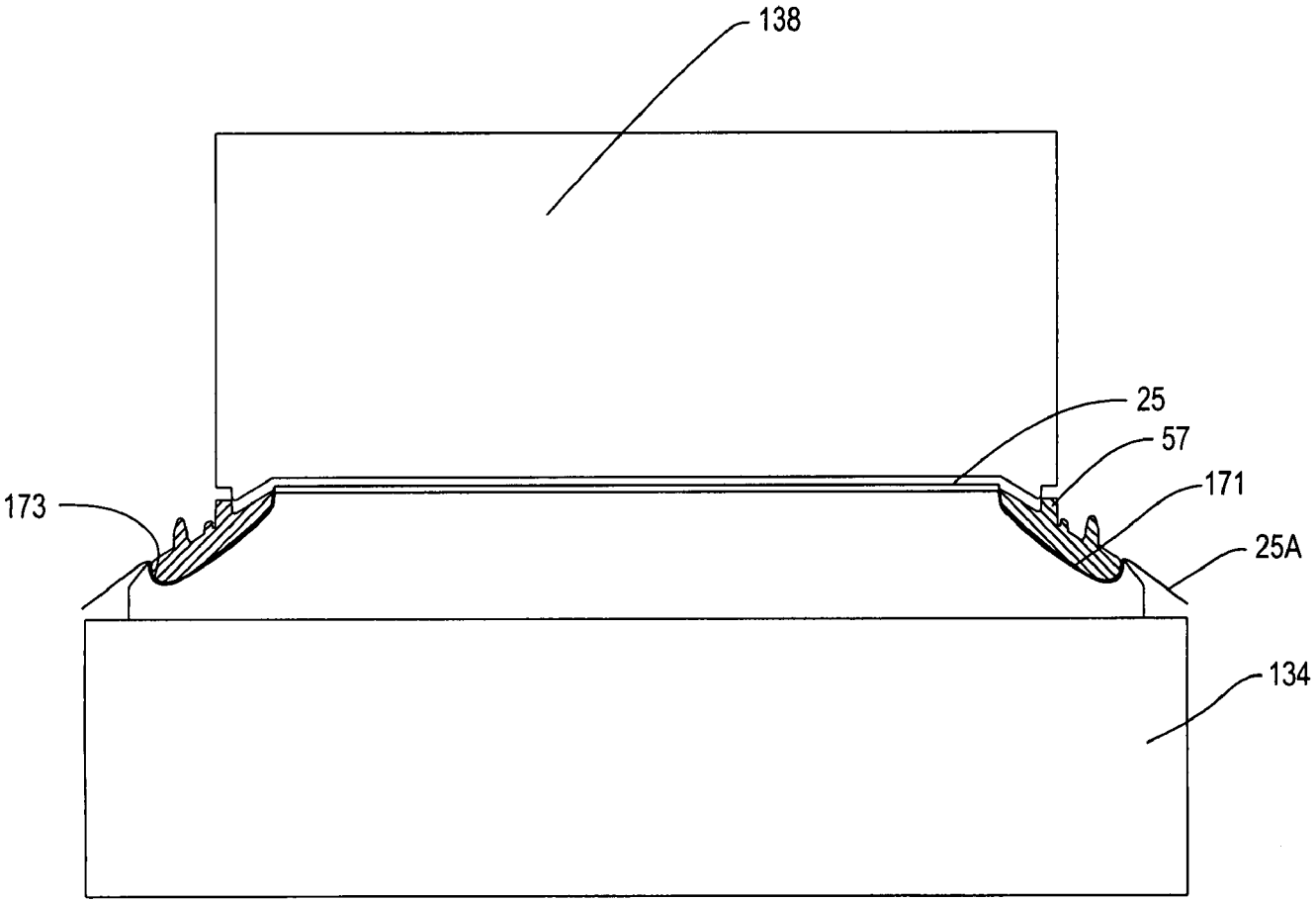
FIG. 30 illustrates the wrapping unit with the clamping head pressed downwardly against a ring section of the back frame.

More particularly as to the individual components, the bottom nest illustrated in FIGS. 26 and 27 is supported on the base unit 133 and includes a contoured surface 170 which faces upwardly. This contoured surface 170 generally corresponds to the contour of the back frame and specifically the front frame section 57. The nest surface 170 is formed with an annular groove 171 which has arcuate inner and outer edges 172 and 173 and conforms to the frame contour. As such, the frame 57 may be tightly fitted into the groove 171 as depicted in FIG. 30. As further seen in FIG. 30, however, the dimension of the groove 171 is also sufficient to permit the thickness of the fabric 25 to be tightly fitted therebetween with the peripheral fabric edge 25A able to extend upwardly past the groove edge 173 and hang outwardly therefrom.

Figure 29:
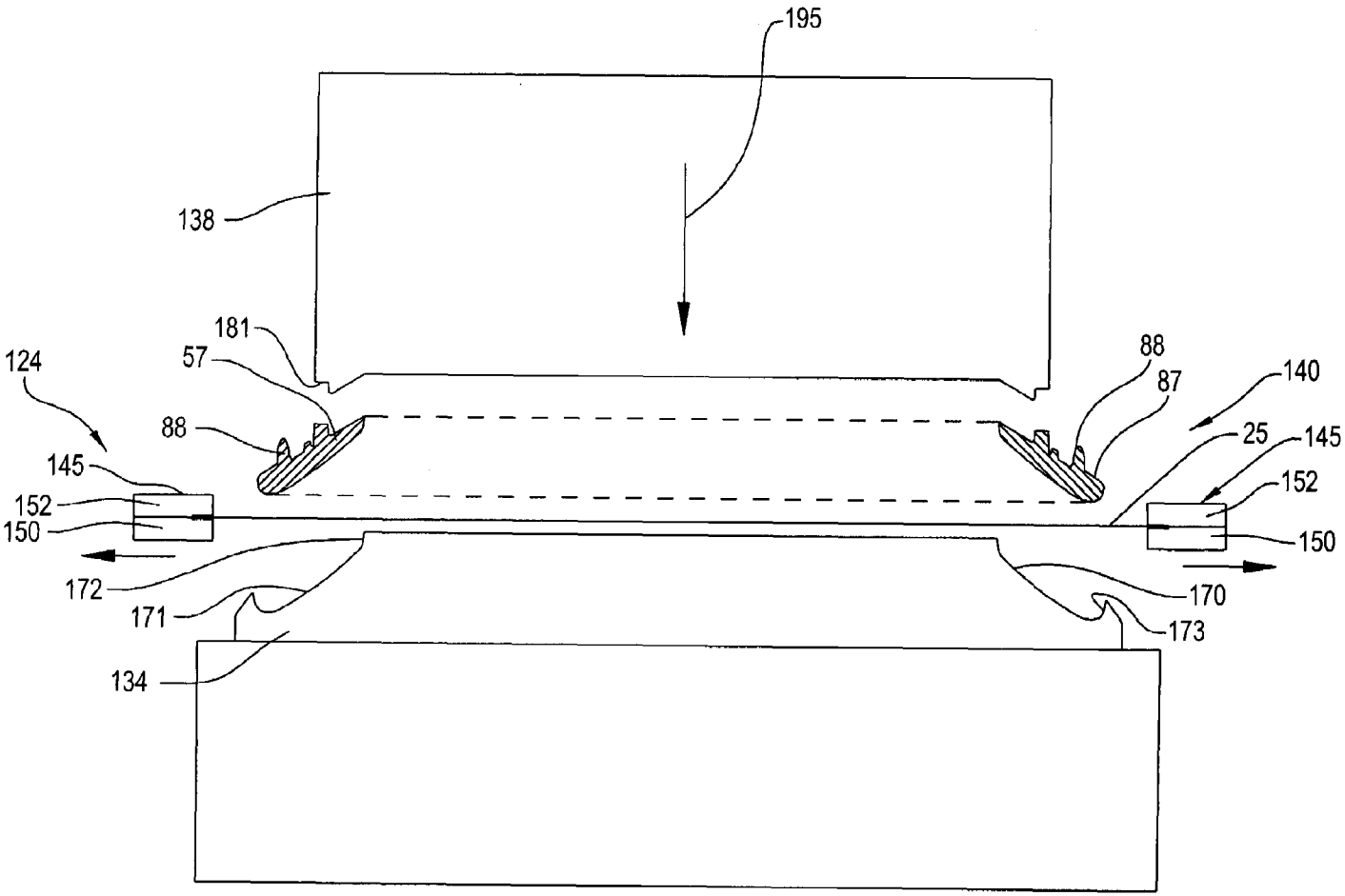
FIG. 29 is a diagrammatic side view of a wrapping unit.

As to the clamping body 138, this clamping body 138 is adapted to not only press downwardly but also hold the front frame section 57 thereon as generally depicted in FIG. 20. This clamping body 138 has a contoured bottom surface 180 which includes a peripheral groove 181. This peripheral groove conforms to the shape of the interior frame face of the frame 57. As seen in FIG. 29, this peripheral groove 181 only extends across a portion of the lateral width of the front frame section 57 so as to leave the outer portion 87 thereof exposed which also leaves exposed the shark teeth or barbs 88. To temporarily secure the frame section 57 within this peripheral groove 181; the groove includes suction ports 190 at each of the corners thereof which project vertically through the thickness of the clamping body 138 and connect to a vacuum source 191 in particular, a fitting 192 that is connected to a vacuum hose 193. Thus, when the frame section 57 is pressed upwardly into the groove 181, a vacuum through the suction port 190 sucks the frame section 57 upwardly and holds same in place.

Therefore during the wrapping process, the shuttle 124 has been displaced sidewardly into the open space 140 so that the fabric 25 overlies the bottom nest 134. Then, the frame section 57 is manually position above the fabric and pressed upwardly into the groove 181 thereof. The vacuum ports 190 thereby hold the frame section 57 in place at which time the clamping body 138 is displaced downwardly as depicted by reference arrow 195 in FIG. 29. As the clamping body is displaced downwardly, this clamping body eventually presses the frame and associated fabric 25 into the groove 171 formed in the bottom nest 134. By tightly pressing the frame section 57 downwardly, the fabric is then clamped between the frame section 57 and the opposing interior face of the groove 171. Because of this clamping action, the above-described clamps 145 are then disengaged from the fabric to permit the fabric edge 25 to hang loose as illustrated in FIG. 30.

Figure 31:
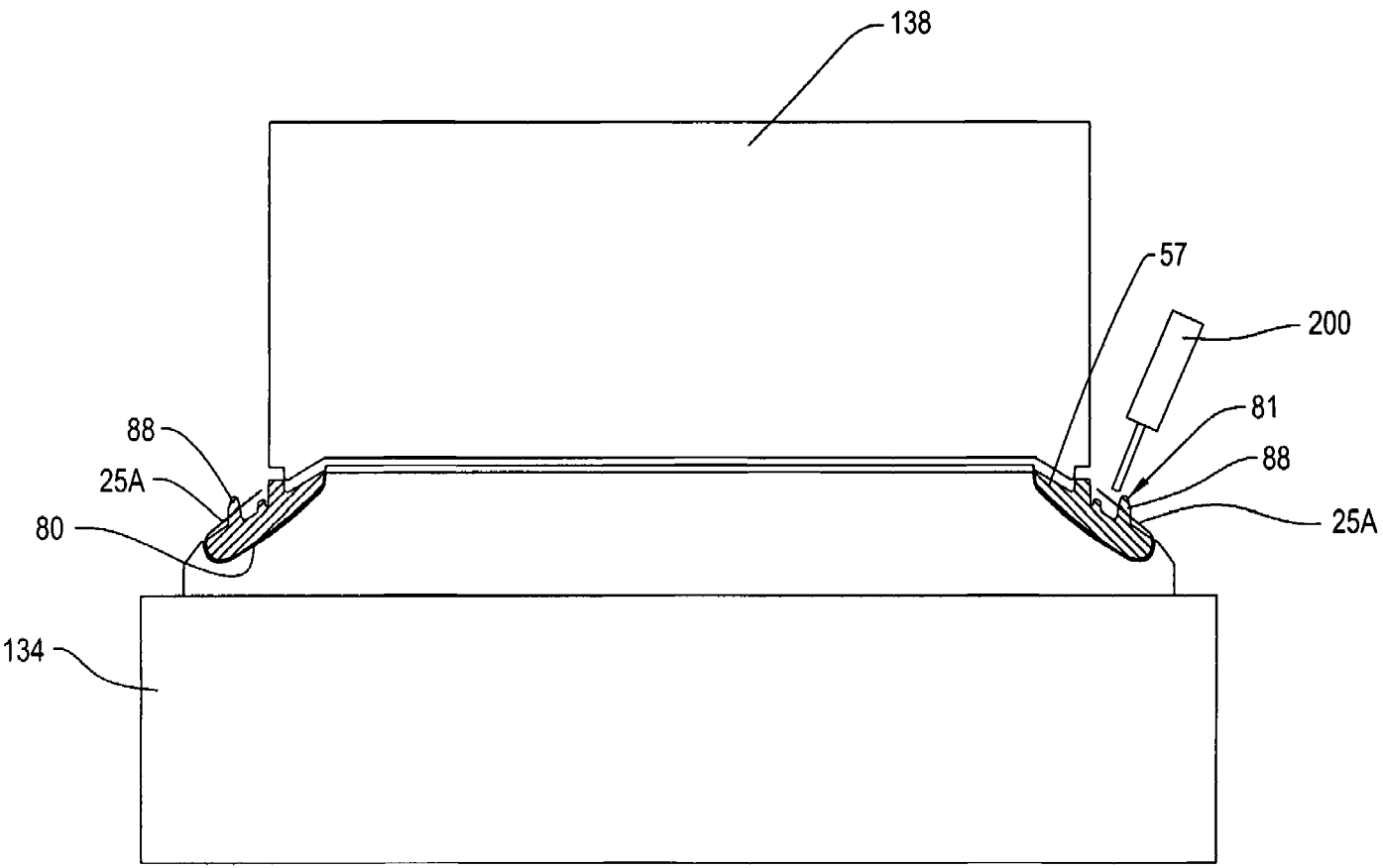
FIG. 31 illustrates a sonic welder being used to attach the fabric to the frame section.

At this point, the fabric edge 25A is permanently affixed to the interior face of the frame section 57. More particularly, the loose fabric edge 25A is folded or wrapped about the front frame face 80 and then is folded rearwardly over the back face 81. As such, the fabric edge 25A is manually pressed downwardly such that the barbs 88 pierce the fabric as seen in FIG. 31.

These barbs provide a temporary holding force after which a sonic welder is manually moved about the periphery of the frame section 57 with the fabric edge 25A being sonically welded to the inside frame face 81 at circumferentially spaced apart positions. Preferably, a localized weld is provided between adjacent pairs of barbs 81. Once the welding operation is completed manually, the upper clamping head 138 may be removed since the fabric 25 is now permanently affixed to the frame section 57. This creates a subassembly 201 of the frame comprising the frame section 57 and the fabric 25. Thereafter, the front frame subassembly is moved to the vibration welder as indicated by step 108 of FIG. 18. In the vibration welder 105, the subassembly 201 is positioned against the rear frame 56 and sonically welded thereto.

Figure 32:
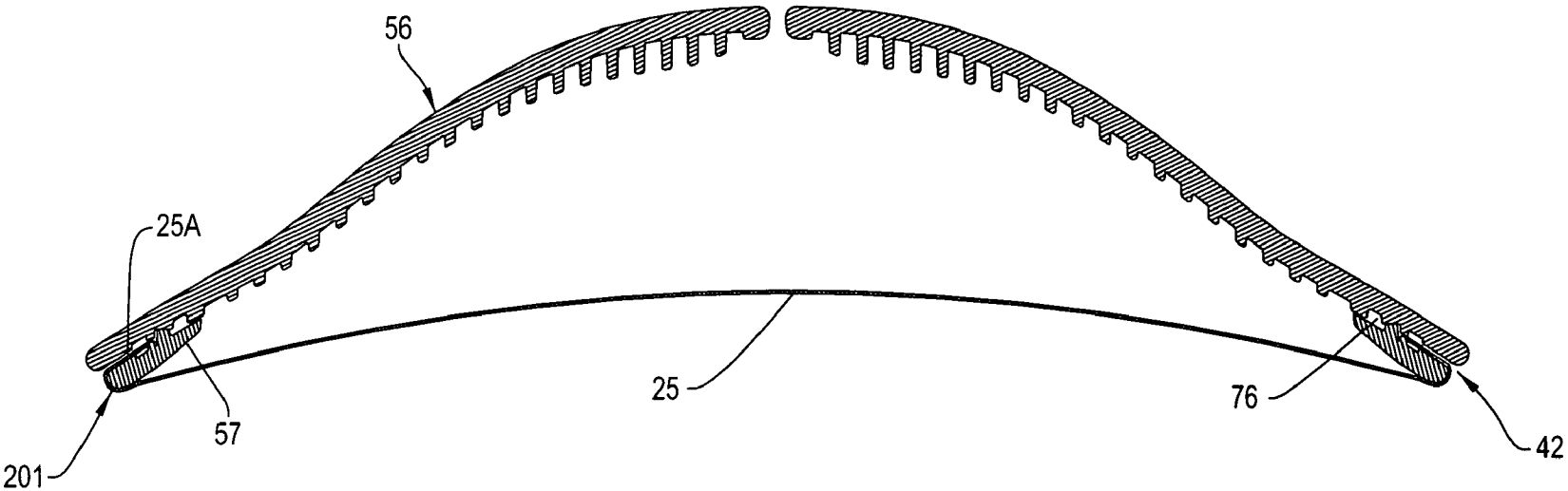
FIG. 32 is a top cross-sectional view of the back frame when fully assembled.

As seen in FIG. 32, the subassembly 201 comprises the frame 57 and fabric 25 which subassembly is in position within the vibration welder 105 adjacent to the rear frame section 56 and its components. Specifically, the opposing contacting faces of these frame sections are welded together. The barbs 88 referenced above also are disposed in contact and provide additional fusing between the component parts 56 and 57 wherein the fabric edge 25A in effect is embedded within the peripheral frame groove 42. This provides a structurally rigid frame construction while also providing for selective tensioning of the fabric 25. Still further, this arrangement permits a complex contoured shape to be developed using conventional mold techniques.

Figure 33:
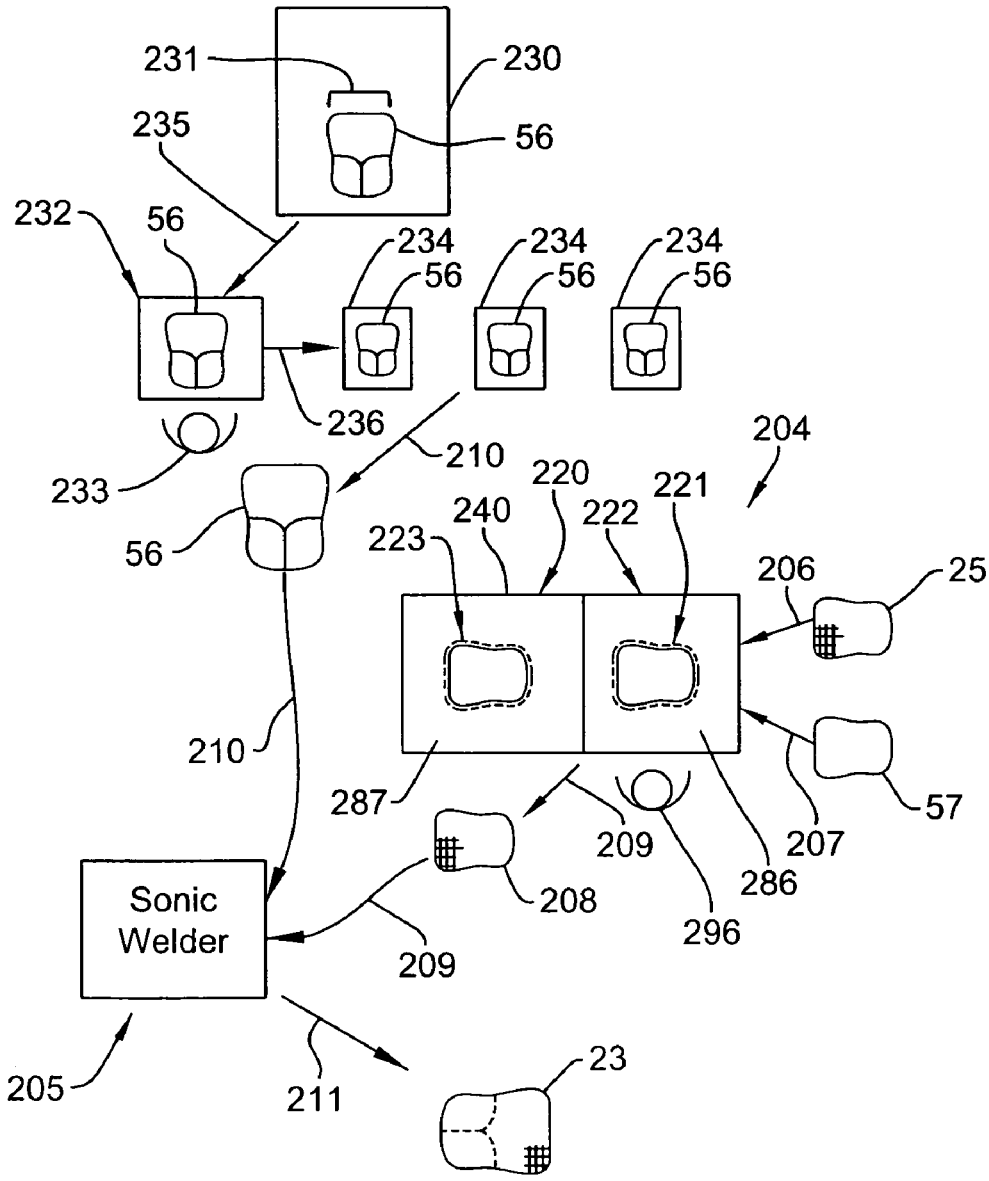
FIG. 33 is a diagrammatic view of a second embodiment of the assembly process for manufacturing the chair frame according to the invention.

Referring to FIG. 33, a second embodiment of the manufacturing system of the invention is illustrated. This embodiment of the system includes a similar stretch and wrap assembly machine 204 and an ultrasonic welder 205. Similarly in these machines, the front frame ring 57 and fabric 25 are positioned in the machine 204 as indicated by arrows 206 and 207, and the assembly machine 204 is then used to stretch the fabric 25, clamp this fabric 25 on the front frame ring 57 and then wrap and attach the fabric edge to the peripheral edge region of the front frame ring 57. This front frame assembly 208 is then transported to the sonic welder 105 as indicated by arrows 209 along with a back frame ring 56 as indicated by reference arrow 210. In the sonic welder 205, the front frame sub-assembly 208 is attached to the rear frame ring 56 to form the back frame 23. The finish back frame 23 is then transported as indicated by reference arrow 211 to a finished stock pile for subsequent assembly to the chair 10.

The following description provides additional detail as to the assembly machine 220 which generally comprises a stretching unit 221 in a wrapping unit 222 as seen in FIG. 33. The stretching unit 221 is configured to stretch the fabric 25 and disposed adjacent to a clamping system which thereby clamps the fabric 25 to the frame 57 and furthermore moves or shuttles the front frame ring 57 and fabric 25 sidewardly to a position wherein a welding or fastening unit 223 fixedly welds the fabric edges to the front frame ring 57.

More particularly as to FIG. 33, the assembly system initially includes a molding machine 230 which individually produces the rear frame unit 56, wherein the individual frame units 56 are picked up one after the other by a lift unit 231 mounted on an overhead gantry that carries the molded rear frame rings 56 to a cooling station 232. At the cooling station 232, the rear frame units 56 are visually inspected by an operator 233 who then manually positions each rear frame unit 56 into cooling fixtures 234 for an appropriate cooling time period. The movement of the rear frame unit 56 from the mold unit 230 to the cooling station 232 is generally indicated by reference arrow 235 while subsequent movement of the frame unit 56 to the fixtures 234 is indicated by reference arrow 236. Thereafter, the frame units 56 are removed from the cooling fixtures 234 and transported to the sonic welder 205 as indicated generally by reference arrow 210.

Simultaneously to the process of forming the rear frame units 56, the sub-assemblies 208 of the front frame ring 57 and fabric 25 are being produced in the assembly machine 220 for subsequent transport to the sonic welder 205. As to this assembly machine 220, this machine generally operates similar to those components described above relative to FIGS. 1-32.

Figure 34:
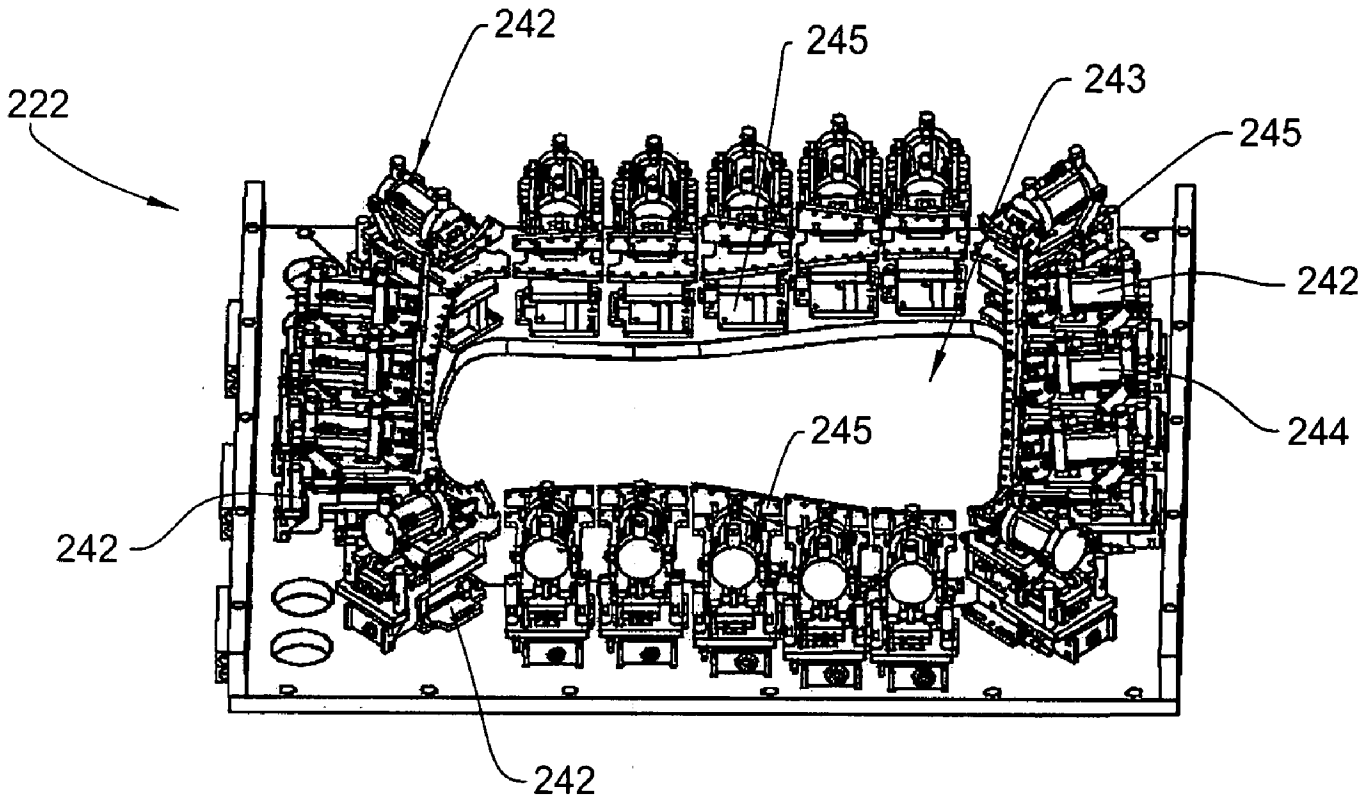
FIG. 34 is an isometric view of the stretching machine.

More particularly as to FIG. 34, FIG. 34 illustrates the stretching unit 221 which is mounted at a fixed elevation on the main base frame 240 of the assembly unit 220. This stretching unit 221 includes a plurality of peripheral clamp assemblies or stretchers 242 which extend inwardly into a frame opening 243 and are adapted to grip substantially the entire peripheral fabric edge 25A in a manner as previously described above. These clamp assemblies 242 each include a pneumatic cylinder 244 that supports and drives the jaw assembly 245. The operation of the jaw assemblies 245 is operated automatically through pneumatic cylinders to selectively open and close and be selectively displaced to thereby stretch the fabric to an appropriate tension. In this manner, the fabric 25 may be placed into the opening 243 with the edges disposed between the openable jaws of the jaw assemblies 245, wherein the fabric edge 25A is then clamped and pulled outwardly.

Figure 35:
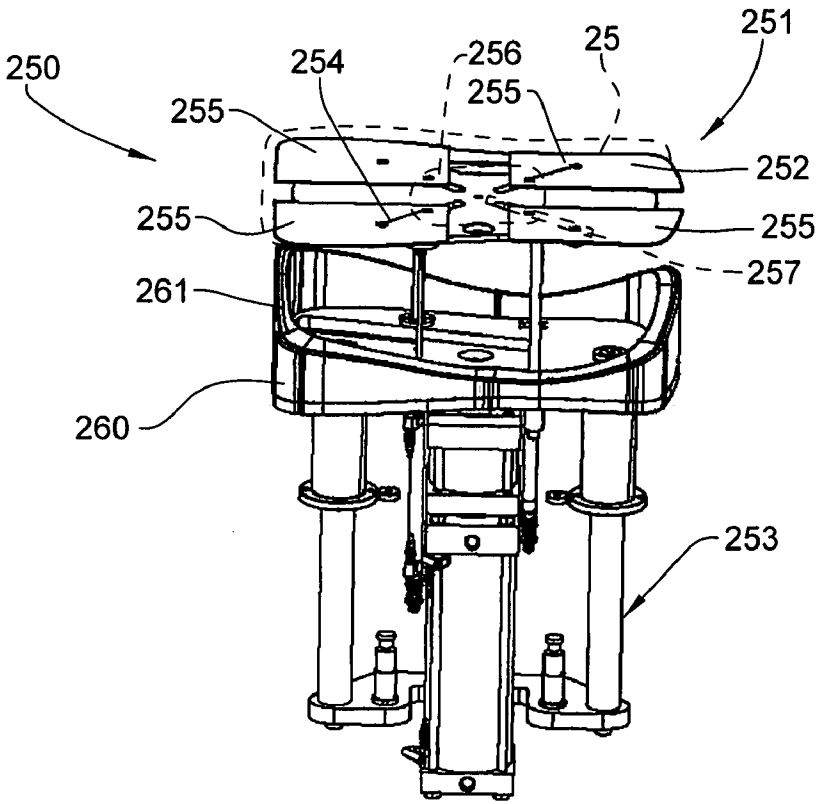
FIG. 35 is an isometric view of an upper nest assembly.

Referring to FIG. 35, the wrapping unit 222 includes a lower nest assembly 250 which is provided downwardly adjacent to the clamp assembly 221. In cooperation with the lower nest assembly 250, an additional support table assembly 251 is provided vertically adjacent thereto which is adapted to be disposed within the stretcher opening 243 described above. This table assembly 251 includes a base plate 252 that is supported vertically by a base unit 253. This plate 252 includes guide slots 254 thereon which vertically support and allow for horizontal sliding of table sections 255 which are essentially arranged in four quadrants. A cam disk 256 is provided which is rotatably driven by a control cylinder 257 wherein rotation of the cam disk 256 causes the table quadrants 255 to be displaced outwardly or inwardly. The support table 252 initially is located within the opening 243 to support the fabric 25 thereon until such fabric is clamped by the clamp assemblies 242. Thereafter, the table assembly 251 is moved downwardly out of the way, to allow for the stretching and clamping operation.

More particularly as to the lower nest unit 250, this unit includes a contoured bottom nest 260 having a contoured surface 261 which faces upwardly and is adapted to press upwardly against the front frame ring 57 and the associated fabric 25, which fabric 25 is thereby clamped between this nest face 261 and the opposing face of the frame ring 57 as will be described in further detail.

Once the fabric 25 is loaded and clamped, the table 251 drops down into an upward-opening cavity within the lower nest 260.

Figure 36:
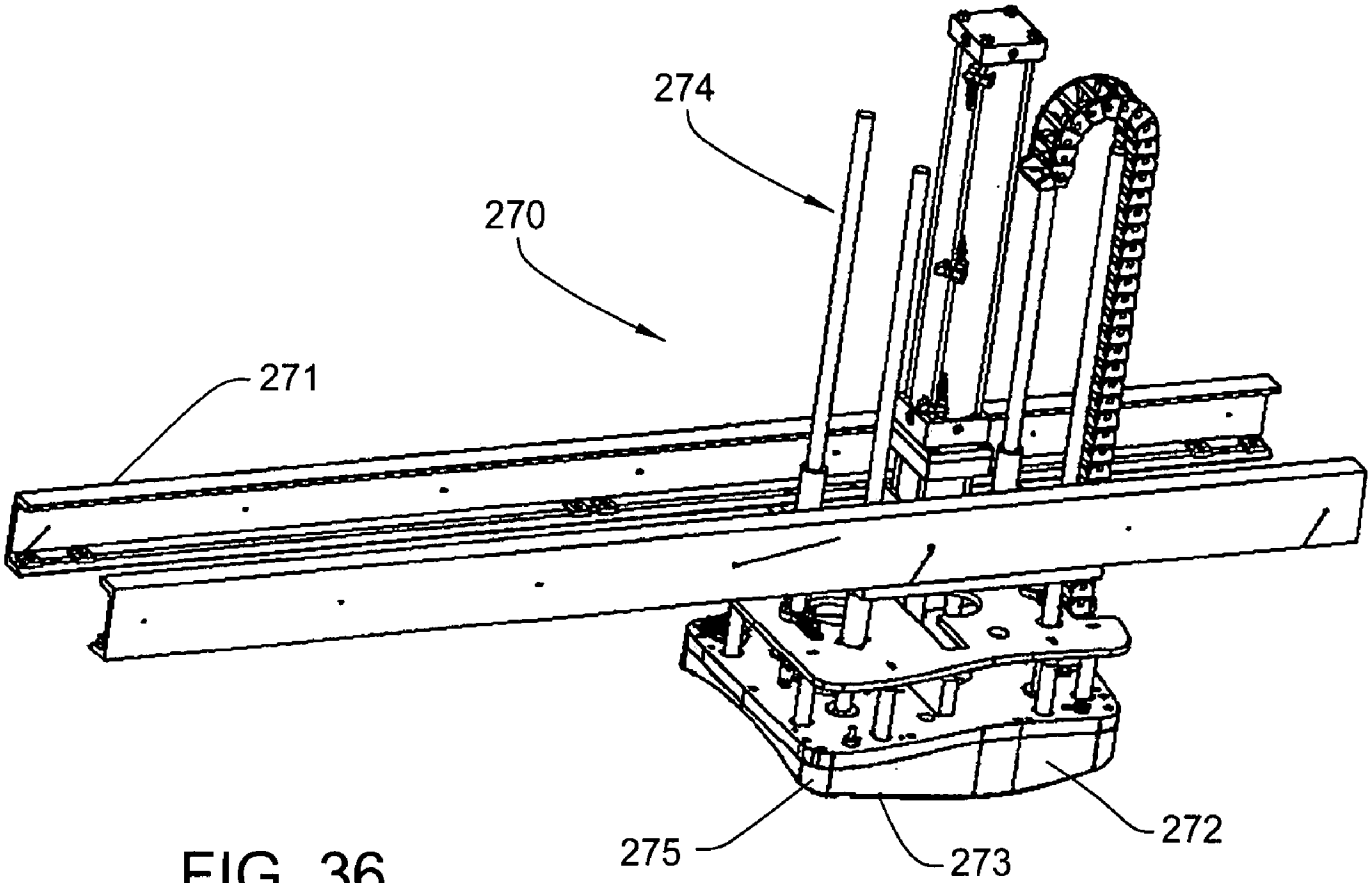
FIG. 36 is an isometric view of the lower nest assembly.

Turning to FIG. 36, an upper nest assembly 270 is illustrated which is supported on an overhead frame rail 271 directly above and in vertical alignment with the lower nest 260. The upper nest assembly 271 includes an upper nest 272 with a downward facing nest face 273. The lower nest 272 is supported by a support structure 274 that is adapted to move the nest 273 downwardly and upwardly. More particularly, this upper nest 273 is then displaced downwardly into the stretcher opening 243 against the stretched fabric 25. Notably, the upper nest face 273 includes a peripheral edge region 275 that is adapted to hold the frame ring 57 thereagainst by appropriate suction or vacuum. Thus, the upper nest 273 moves this attached frame ring 57 downwardly against the fabric 25 and then continues to press this fabric downwardly against the upward facing nest face 261 by which the fabric 25 and ring 57 are now clamped between the upper nest 273 and lower nest 260.

Figure 3:
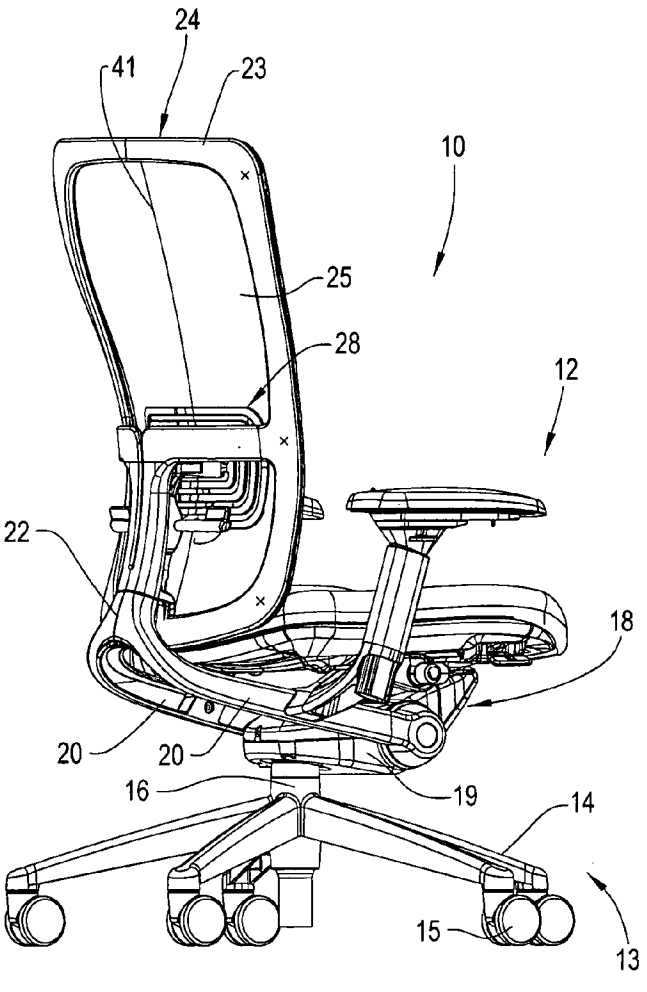
FIG. 3 is a rear isometric view thereof.
Figure 37:
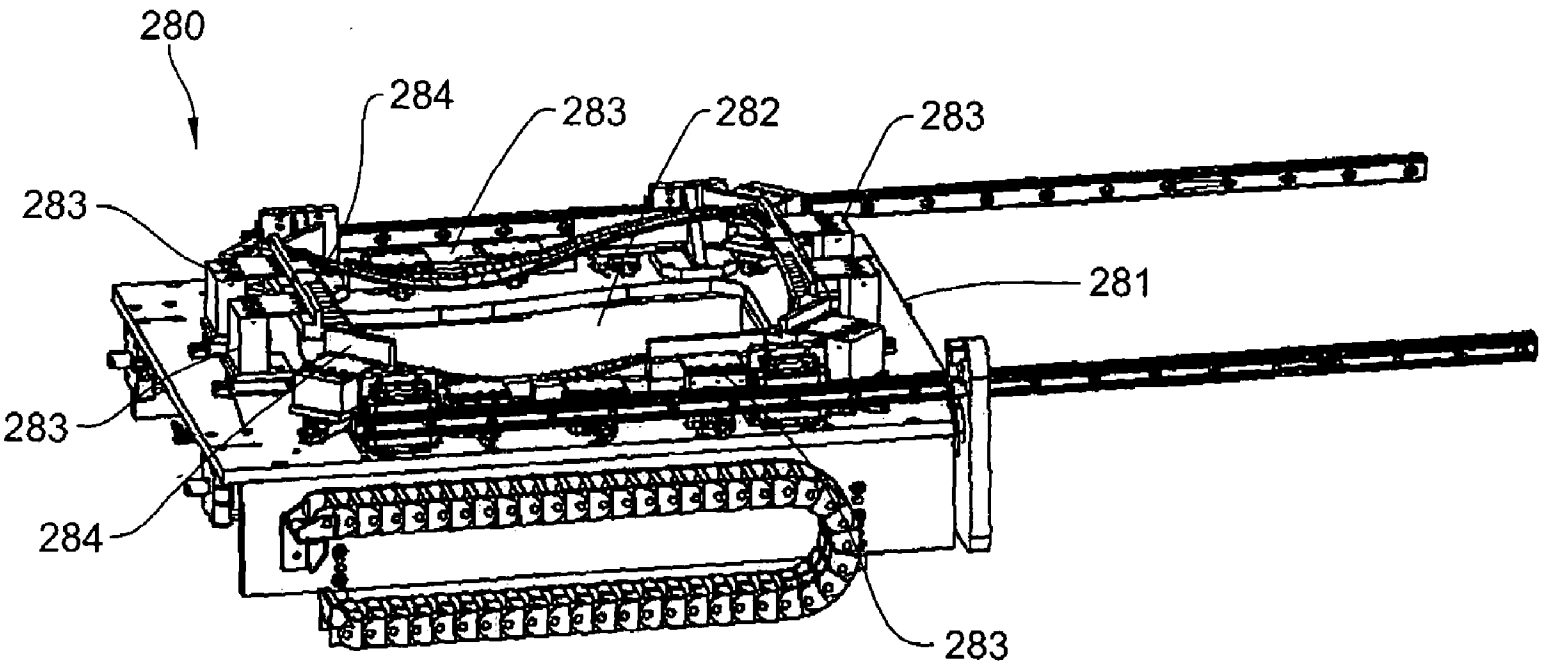
FIG. 37 is an isometric view of a fabric side clamp assembly.

Turning to FIG. 37, a further side clamp assembly 280 is illustrated which is disposed in the wrapping unit 222 directly below the fabric clamp assembly 222. This side clamp assembly 280 includes a top plate 281 that defines a central opening 282 in which is disposed the lower nest 260. The side clamp assembly 280 further includes a plurality of sidewardly movable clamp units 283 having a clamp plate 284 that is movable sidewardly against the peripheral edge of the frame ring 57 to thereby hold the stretch fabric 25 in its stretched condition on the frame ring 57. As a result, the lower nest assembly 253, the table unit 251, and this side clamp assembly 280 all are configured as a movable unit which is adapted to be displaced sidewardly from the rightward clamping side 286 of the stretching machine as seen in FIG. 3 to the left side 287. In effect, these components serve to shuttle the stretched fabric 25 and ring 57 sidewardly to the adjacent welding machine 223 which is provided to preliminarily affix the stretched fabric 25 to the frame ring 57. Notably, the clamping assembly 222 remains stationary on the right machine side 286 while the remainder of the components described above move leftwardly to shuttle the frame ring 57 and stretched fabric 25.

Figure 38:
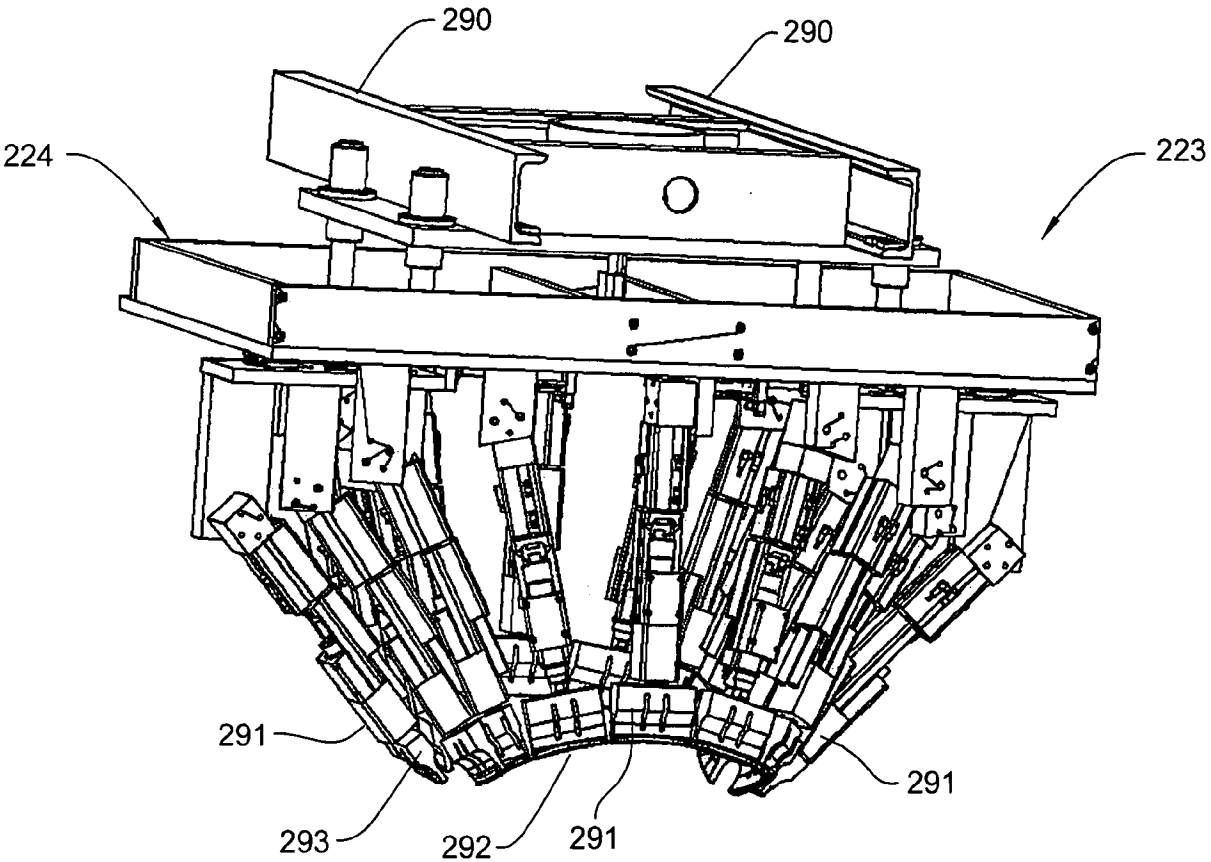
FIG. 38 is an isometric view of the sonic welder assembly.

Referring to FIG. 38, the sonic welder unit 223 is illustrated which has a support plate 224 supported by overhead beam structure 290. This sonic welder unit 223 includes a plurality of individual sonic welders 291 arranged about an open region 292 having the same general shape as the frame ring 57. Each of the sonic weld units 291 is downwardly telescoping so as to be individually movable toward the frame ring 57. These weld units 291 include an outer distal weld edge 293 that is adapted to contact the fabric in the peripheral edge region of the frame ring 57 so as to sonically weld the fabric 25 in the stretched condition onto the front frame ring 57. These sonic weld units 291 are movable sequentially in a selected pattern to weld selected portions sequentially.

Prior to welding, the side clamp assembly 280 preferably also has wiper jaws which move sidewardly into the corner regions of the frame 57 to ensure appropriate folding of the fabric 25 over this edge section. Once the welding step is performed by this sonic weld machine 223, the entire shuttle assembly moves rightwardly back to the appropriate position in the right machine section 286, after which the table assembly 251 is raised to the elevated position to lift the sub-assembly 208 of the frame ring 57 and fabric 25 upwardly back into the opening 243 for manual removal by the operator 296. This operator 296 then takes the sub-assembly 208 and positions said sub-assembly 208 in the sonic welder 205 along with the rear frame unit 56 which components are then automatically pressed together and sonically welded in final, permanent engagement. The final frame assembly 23 is then removed therefrom.

Although particular preferred embodiments of the invention have been disclosed in detail for illustrative purposes, it will be recognized that variations or modifications of the disclosed apparatus, including the rearrangement. of parts, lie within the scope of the present invention.

What is claimed is:

1. A method for assembling a frame assembly for a chair comprising the steps of:

providing a first frame body having an elongate shape defined by a first peripheral frame edge, and inside and outside faces;

providing a second frame body having an elongate shape defined by a second peripheral frame edge, and inside and outside faces, wherein said first and second frame bodies when assembled define a frame having a frame opening;

positioning a fabric in a stretching machine and stretching said fabric along transverse first and second axes to a selected tension;

positioning said first frame body adjacent a face of said stretched fabric wherein said stretched fabric overlies said first frame body;

fastening a peripheral fabric edge of said stretched fabric to said adjacent first peripheral frame edge to define a frame sub-assembly;

positioning said second frame body with said inside face thereof disposing in opposed facing relation with said inside face of said first frame body; and fixing said first and second frame bodies together to fixedly secure said peripheral fabric edge between said opposing inside faces of said first and second frame bodies with said stretched fabric overlying said frame opening to define said frame assembly.

2. The method according to claim 1, which includes the step of wrapping said peripheral fabric edge about said peripheral frame edge of said first frame body so that said peripheral fabric edge overlies said inside face of said first frame edge adjacent said peripheral frame edge thereof.

3. The method according to claim 2, which includes the step of initially clamping said stretched fabric against said first frame body to maintain said fabric stretched before said fastening of said stretched fabric to said first frame body.

4. The method according to claim 3, which includes the step of gripping said peripheral fabric edge of said unstretched fabric for said stretching step.

5. The method according to claim 4, which includes the step of releasing said gripping of said peripheral fabric edge by said stretching machine after said clamping step.

6. The method according to claim 1, which includes the steps of providing first and second clamping nests and displacing said first and second clamping nests one toward the other to clamp said stretched fabric against said first frame body.

7. The method according to claim 1, wherein said peripheral fabric edge is sonically welded to said peripheral edge of said first frame body during said fastening step.

8. The method according to claim 1, wherein said first and second frame bodies are sonically welded together during said fixing step with said peripheral fabric edge sandwiched in sonically welded relation between said first and second frame bodies.

9. A method for assembling a frame assembly for a chair comprising the steps of:

providing a first frame ring having a ring-like shape defined by a first peripheral frame edge, and inside and outside faces;

providing a second frame ring having a ring-like shape defined by a second peripheral frame edge, and inside and outside faces, wherein said first and second frame rings when assembled define a frame;

positioning a fabric in a stretching machine, gripping a peripheral edge of said fabric and stretching said fabric to a selected tension;

positioning said first frame ring adjacent a face of said stretched fabric wherein said stretched fabric overlies said outside face of said first frame ring;

wrapping said peripheral fabric edge about said peripheral frame edge of said first frame ring so that said peripheral fabric edge overlies said inside face of said first frame edge adjacent said first peripheral frame edge thereof;

fastening said peripheral fabric edge of said stretched fabric to said adjacent first peripheral frame edge to define a frame sub-assembly;

positioning said second frame ring with said inside face thereof disposing in opposed facing relation with said inside face of said first frame ring; and fixing said first and second frame rings together to fixedly secure said peripheral fabric edge between said opposing inside faces of said first and second frame rings to define said frame assembly.

10. The method according to claim 9, which includes the step of initially clamping said stretched fabric against said first frame body to maintain said fabric stretched before said fastening of said stretched fabric to said first frame body.

11. The method according to claim 10, which includes the step of releasing said gripping of said peripheral fabric edge by said stretching machine after said clamping step.

12. The method according to claim 9, which includes the steps of providing first and second clamping nests and displacing said first and second clamping nests one toward the other to clamp said stretched fabric against said first frame body, after which said gripping of said peripheral fabric edge is released.

13. The method according to claim 12, wherein said fastening step is performed after said gripping is released.

14. The method according to claim 9, wherein said peripheral fabric edge is sonically welded to said peripheral edge of said first frame body during said fastening step.

15. The method according to claim 9, wherein said first and second frame bodies are sonically welded together during said fixing step with said peripheral fabric edge sandwiched in sonically welded relation between said first and second frame bodies.

16. A method for assembling a frame assembly for a chair comprising the steps of:

providing a first frame ring having a ring-like shape defined by a first peripheral frame edge, and inside and outside faces;

providing a second frame ring having a ring-like shape defined by a second peripheral frame edge and inside and outside faces, wherein said first and second frame rings when assembled define a frame;

positioning a fabric in a stretching machine, gripping a peripheral edge of said fabric and stretching said fabric to a selected tension;

positioning said first frame ring adjacent a face of said stretched fabric wherein said stretched fabric overlies said outside face of said first frame ring;

clamping said stretched fabric against said first frame body to maintain said fabric stretched;

fastening said peripheral fabric edge of said stretched and clamped fabric to said adjacent first peripheral frame edge to define a frame sub-assembly;

positioning said second frame ring with said inside face thereof disposing in opposed facing relation with said inside face of said first frame ring; and fixing said first and second frame rings together to fixedly secure said peripheral fabric edge between said opposing inside faces of said first and second frame rings to define said frame assembly with said peripheral fabric edge sandwiched in fixed relation between opposing inside faces of said first and second frame bodies.

17. The method according to claim 16, which includes the step of releasing said gripping of said peripheral fabric edge by said stretching machine after said clamping step.

18. The method according to claim 16, wherein said fastening step is performed after said gripping is released.

19. The method according to claim 16, which includes the steps of providing first and second clamping nests and displacing said first and second clamping nests one toward the other to clamp said stretched fabric against said first frame body, after which said gripping of said peripheral fabric edge is released.

20. The method according to claim 16, wherein said first and second frame bodies are sonically welded together during said fixing step.

* * * * *